US011808187B2

(12) United States Patent
Landwehr et al.

(10) Patent No.: US 11,808,187 B2
(45) Date of Patent: Nov. 7, 2023

(54) NOISE ATTENUATION COMPONENTS

(71) Applicant: Caterpillar Inc., Peoria, IL (US)

(72) Inventors: Dustin Irvin Landwehr, Kewanee, IL (US); Jim K Carroll, Peoria, IL (US); David Charles Copley, Peoria, IL (US); Rakesh Chandran Ramachandran, Dunlap, IL (US); Timothy Josiah Lee, Morton, IL (US); Yung T. Bui, Peoria, IL (US); Anthony C. Rodman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 313 days.

(21) Appl. No.: 17/189,252

(22) Filed: Mar. 1, 2021

(65) Prior Publication Data

US 2022/0275737 A1 Sep. 1, 2022

(51) Int. Cl.

| | |
|---|---|
| ***F01N 1/02*** | (2006.01) |
| ***F01N 1/04*** | (2006.01) |
| ***F01N 3/28*** | (2006.01) |

(52) U.S. Cl.

CPC ..... *F01N 1/023* (2013.01); *F01N 1/04* (2013.01); *F01N 3/2825* (2013.01); *F01N 2330/06* (2013.01); *F01N 2490/155* (2013.01)

(58) Field of Classification Search

CPC ..... F01N 1/023; F01N 1/04; F01N 2490/155; F01N 3/0335; F01N 3/2885; F01N 3/2825; F01N 2330/06

See application file for complete search history.

(56) References Cited

U.S. PATENT DOCUMENTS 4,050,903 A * 9/1977 Bailey ..... F01N 3/2885 422/177
4,064,962 A 12/1977 Hunt
4,209,493 A * 6/1980 Olson ..... F01N 3/34 60/308
5,243,819 A * 9/1993 Woerner ..... F01N 3/031 60/299

(Continued)

FOREIGN PATENT DOCUMENTS

CN 210003661 U 1/2020
EP 1400662 B1 3/2004

(Continued)

*Primary Examiner* — Jeremy A Luks
(74) *Attorney, Agent, or Firm* — Lee & Hayes, P.C.

(57) ABSTRACT

A reduction device includes a housing defining an input chamber configured to receive exhaust from a power source, an output chamber, an exhaust channel configured to direct the exhaust from the input chamber to the output chamber, and a longitudinal axis. The reduction device also includes a treatment unit disposed in the exhaust channel and along the longitudinal axis. The treatment unit is configured to at least partly remove pollutant species from the exhaust. The reduction device also includes an attenuation component disposed in the housing and radially outward of the treatment unit. The attenuation component is fluidly connected to the exhaust channel, and is configured to attenuate a range of frequencies corresponding to operation of the power source. Additionally, the exhaust channel prohibits exhaust entering the input chamber from exiting the housing without passing through the treatment unit.

20 Claims, 11 Drawing Sheets

(56) References Cited

U.S. PATENT DOCUMENTS

| | | | | |
|---|---|---|---|---|
| 8,646,573 | B2 * | 2/2014 | Werni | F01N 13/008 60/299 |
| 10,781,732 | B2 | 9/2020 | Nousiainen | |
| 10,823,036 | B1 * | 11/2020 | Egan | F01N 13/008 |
| 2003/0000208 | A1 * | 1/2003 | Knight | F01N 1/165 60/299 |
| 2006/0277900 | A1 * | 12/2006 | Hovda | F01N 13/1844 60/299 |
| 2009/0272106 | A1 * | 11/2009 | Werni | F01N 13/017 60/299 |
| 2010/0061898 | A1 * | 3/2010 | Lehnen | F01N 3/2066 422/168 |
| 2017/0276043 | A1 * | 9/2017 | Khan | F01N 3/0335 |
| 2019/0093528 | A1 * | 3/2019 | Egan | G10K 11/172 |
| 2020/0182111 | A1 * | 6/2020 | Madi | G10K 11/162 |
| 2021/0123368 | A1 * | 4/2021 | Akyildiz | F01N 13/141 |
| 2021/0262374 | A1 * | 8/2021 | Keesser | F01N 1/023 |

FOREIGN PATENT DOCUMENTS

| | | | |
|---|---|---|---|
| GB | 417935 | A | 10/1934 |
| WO | WO2007/101412 | A1 | 9/2007 |
| WO | WO2019/015845 | A1 | 1/2019 |

* cited by examiner

NOISE ATTENUATION COMPONENTS

TECHNICAL FIELD

The present disclosure relates to noise attenuation systems for internal combustion engines. More specifically, the present disclosure relates to exhaust treatment systems, and corresponding noise attenuation components that are tunable to attenuate noise in one or more frequency ranges.

BACKGROUND

Internal combustion engines, including diesel engines, gasoline engines, natural gas engines, gaseous fuel-powered engines, and other engines known in the art exhaust a complex mixture of air pollutants. These air pollutants are composed of gaseous compounds such as nitrogen oxides ($NO_X$), and solid particulate matter also known as soot. Due to increased awareness of the environment, exhaust emission standards have become more stringent, and the amount of $NO_X$ and soot emitted to the atmosphere by an engine may be regulated depending on the type of engine, size of engine, and/or class of engine.

In order to ensure compliance with the regulation of $NO_X$, some engine manufacturers employ strategies in which the exhaust gas is passed through a diesel particulate filter (DPF), an oxidation catalyst, or other aftertreatment devices in order to remove particulates and other pollutants carried by the exhaust. Additionally or alternatively, a selective catalytic reduction (SCR) process can be employed in which a gaseous or liquid reductant, most commonly urea, is injected into the exhaust gas stream and is absorbed onto a substrate. The reductant reacts with $NO_X$ in the exhaust gas to form $H_2O$ and $N_2$. However, passing exhaust gas through a DPF, an SCR device, or other aftertreatment devices downstream of the internal combustion engine can generate a significant level of noise. Accordingly, some noise-sensitive locations require the use of noise attenuation components, such as mufflers, configured to reduce exhaust-related noise in various frequency ranges.

An example system for sound attenuation is described in U.S. Patent Application No. 2017/0218806 (hereinafter referred to as the '806 reference). In general, the '806 reference describes a muffler system with three chambers for sound attenuation. Additionally, the '806 reference describes a system that includes an input pipe that delivers exhaust gas into the muffler and propagates sound into the internal chamber of the muffler that is configured to attenuate the sound through internal geometry to cause destructive interference. Internally, the muffler of the '806 reference describes that the internal structure of the muffler may be divided into three chambers that provide attenuation and are in fluid communication with the exhaust as it passes through the muffler.

Although the system described in the '806 reference may be configured to attenuate noise associated with engine exhaust gas, the system is not easily configurable or "tunable" by the user. For example, the system described in the '806 reference is not tunable to facilitate the attenuation of particular frequency ranges specific to the engine and/or reduction devices with which it is used. Additionally, due to the large number of unique parts included in the system of the '806 reference, use of this system may increase the overall cost and complexity of the reduction device.

Examples of the present disclosure are directed toward overcoming one or more of the deficiencies noted above.

SUMMARY OF THE INVENTION

Examples of the present disclosure are directed to a reduction device that includes a housing, an input chamber, an output chamber, an exhaust channel, a longitudinal axis, a treatment unit, and an attenuation unit. The housing can include the input chamber configured to receive exhaust from a power source, the output chamber downstream of the input chamber, the exhaust channel disposed between the input chamber and the output chamber, the exhaust channel configured to direct the exhaust from the input chamber to the output chamber, and the longitudinal axis extending substantially centrally through the housing. Additionally, the treatment unit can be disposed in the exhaust channel and along the longitudinal axis, the treatment unit being configured to at least partly remove pollutant species from the exhaust as the exhaust passes through the exhaust channel. Further, the attenuation component can be disposed in the housing and radially outward of the treatment unit, wherein the attenuation component is fluidly connected to the exhaust channel, and is configured to attenuate a range of frequencies corresponding to operation of the power source at a rated load and the exhaust channel prohibits exhaust entering the input chamber from exiting the housing without passing through the treatment unit.

Further examples of the present disclosure are directed to a method that includes receiving exhaust at an input chamber of a housing, the input chamber being in fluid communication with an output chamber of the housing via an exhaust channel of the housing. Additionally, the method includes attenuating, with an attenuation component disposed within the housing and fluidly connected to the exhaust channel, a range of frequencies associated with the exhaust as the exhaust passes through the exhaust channel. Further, the method includes removing, with at least one of a first treatment unit and a second treatment unit, a pollutant species from the exhaust as the exhaust passes through the exhaust channel. It should be noted that the first treatment unit being disposed within the exhaust channel, the second treatment unit being disposed within the exhaust channel downstream of, and spaced from, the first treatment unit, and the attenuation component being disposed radially outward of the first treatment unit and the second treatment unit. Further the method includes directing the exhaust to exit the housing via the output chamber, the exhaust channel prohibiting the exhaust from exiting the housing via the output chamber without passing through the at least one of the first treatment unit and the second treatment unit.

Still further examples of the present disclosure are directed to a system that includes a power source configured to emit exhaust and a reduction device fluidly connected to the power source and configured to receive the exhaust. For example, the reduction device can include a housing, an exhaust channel, a plurality of treatment units, and a plurality of attenuation units. In particular, the housing unit can define an input chamber, an output chamber downstream of the input chamber, and a longitudinal axis. Additionally, the exhaust channel can fluidly connect the input chamber with the output chamber and the longitudinal axis of the housing can extend substantially centrally through the exhaust channel. Further, the plurality of treatment units can be disposed within the exhaust channel, the plurality of treatment units being configured to remove pollutant species from the exhaust as the exhaust passes through the exhaust channel.

It should be noted that the plurality of attenuation components disposed within the housing and fluidly connected to the exhaust channel, the plurality of attenuation components being configured to attenuate a range of frequencies associated with the exhaust passing through the exhaust channel, corresponding to operation of the power source at a rated power load, and being disposed radially outward of the plurality of treatment units. Additionally, a support lattice can be connected to at least one wall of the exhaust chamber and supporting the plurality of treatment units within the exhaust channel, wherein the reduction device is configured such that the exhaust received from the power source is prohibited from exiting the housing without passing through at least one treatment unit of the plurality of treatment units.

DETAILED DESCRIPTION

Systems and techniques described below are directed to reduction devices that comprise noise attenuation components (e.g., resonators, attenuation materials, etc.) in addition to catalysts, exhaust processing components, and other internal components. As will be described below, example reduction devices of the present disclosure are configured to remove pollutants from combustion exhaust gas, and are also tunable to minimize noise in frequency ranges specific and/or particular to the engine or other power systems to which they are connected.

Figure 1:
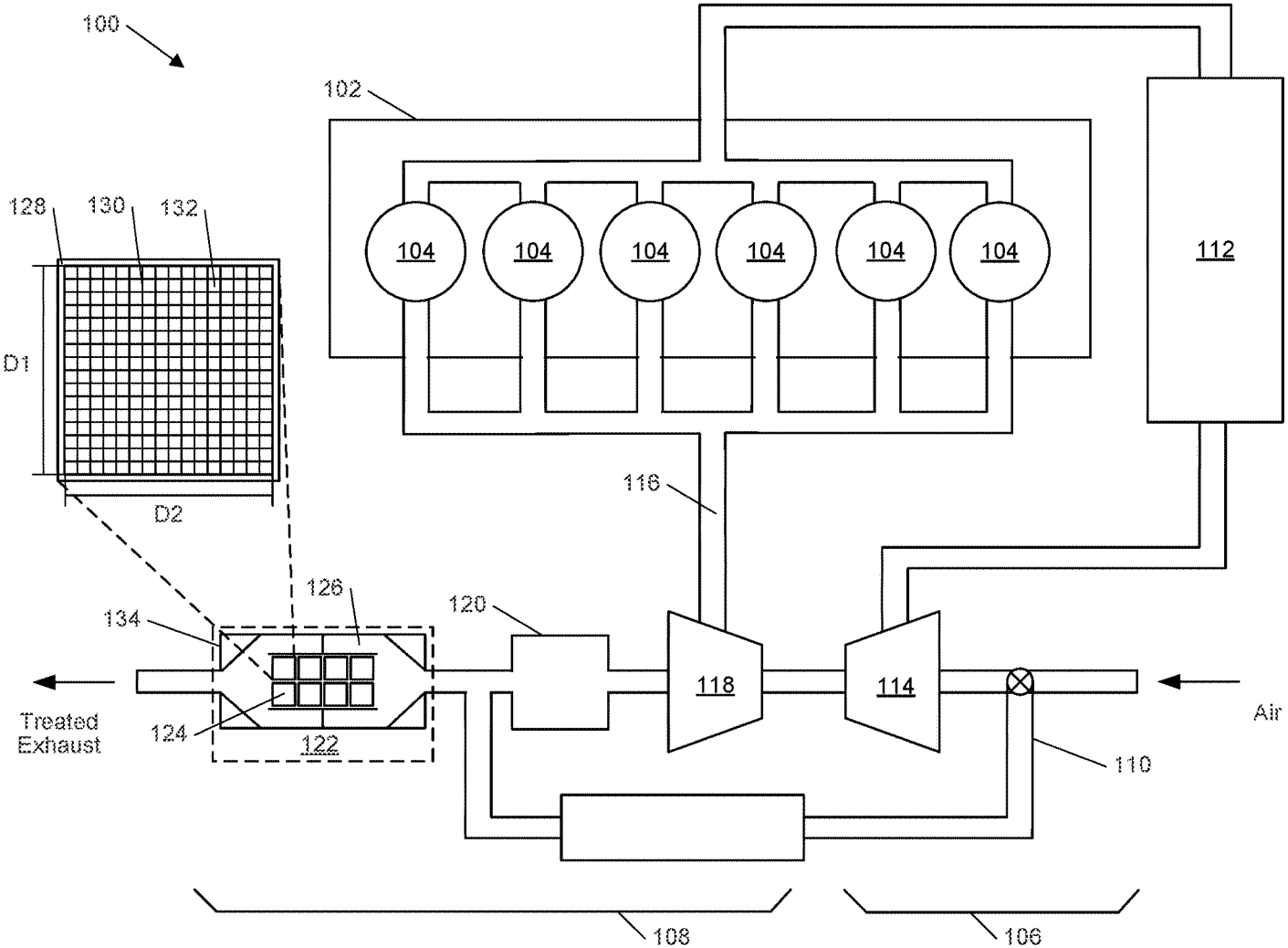
FIG. 1 illustrates an exemplary power system, such as a diesel-fueled internal combustion engine, that outputs exhaust according to examples of the present disclosure.

FIG. 1 illustrates an exemplary power system 100. For the purposes of this disclosure, the power system 100 is depicted and described as a diesel-fueled, internal combustion engine. However, it is contemplated that the power system 100 may embody any other type of combustion engine, such as, for example, a gasoline, a hydrogen, a natural gas, a liquid fuel, or gaseous fuel powered engine. The power system 100 may include an engine block 102 at least partially including a plurality of cylinders 104, and a plurality of piston assemblies (not shown) disposed within the plurality of cylinders 104 to form combustion chambers. It is contemplated that the power system 100 may include any number of combustion chambers and that the combustion chambers may be disposed in an "in-line" configuration, a "V" configuration, or in any other conventional configuration. In at least one example, the diesel-fueled internal combustion engine can be a part of a set of generators (e.g., a "gen-set") that provide power for a facility. Accordingly, while the power system 100 is depicted as including a single engine block, the power system 100 can be configured to include a plurality of engine blocks. It should be noted that the power system can be any power generating component that utilizes an internal combustion engine such as the gen-set, a maritime engine, a motor, an industrial system that utilizes internal combustion, and other related applications.

In some examples, the power system 100 can be a gen-set configured to output power for the facility via operation of the plurality of cylinders 104 at a rated power load that correlates to a number of rotations per minute (RPM) by the plurality of cylinders 104. In particular, the power system 100, depending on the power environment where the power system 100 is installed, can be configured to continuously or substantially continuously output the rated power load. The rated power load can be a defined power load that is approximately equivalent to a percentage of a maximum power load of the engine block 102 (e.g., 60%, 75%, 80%, 90%, etc. of the maximum power output) and approximately represents the anticipated operation parameters of the power system 100. Additionally, and based at least on the rated power load, an exhaust temperature can be determined for the power system 100 that is associated with operation of the engine block 102 and the plurality of cylinders 104. It should be noted that in applications where the power system 100 is configured to operate at a variable power load (e.g., power load is freely adjusted within an operating power output range), the power system 100 can be associated with a range of cylinder RPMs and a range of exhaust temperatures that are generated by the power system 100 during operation within the range of the variable power load. Accordingly, systems that receive exhaust from the power system 100 and/or the engine block 102 can be configured to operate at the rated power load and/or within the range of the variable power load.

Multiple separate sub-system may be included within the power system 100. For example, the power system 100 may include an air induction system 106, an exhaust system 108, and a recirculation loop 110. The air induction system 106 may be configured to direct air, oxidation agents, and/or an air and fuel mixture, into the power system 100 for subsequent combustion. The exhaust system 108 may exhaust byproducts of the combustion to the atmosphere. The recirculation loop 110 may be configured to direct a portion of the gases from the exhaust system 108 back into the air induction system 106 for subsequent combustion.

The air induction system 106 may include multiple components that cooperate to condition and introduce compressed air into the plurality of cylinders 104. For example, the air induction system 106 may include an air cooler 112 located downstream of one or more compressors 114. The one or more compressors 114 may be connected to pressurize inlet air directed through the air cooler 112. It is contemplated that the air induction system 106 may include different or additional components than described above such as, for example, a throttle valve, variable valve actuators associated with each cylinder of the plurality of cylinders 104, filtering components, compressor bypass components, and other known components, if desired. It is further contemplated that the one or more compressors 114 and/or the air cooler 112 may be omitted, if a naturally aspirated engine is desired.

The exhaust system 108 may include multiple components that condition and direct exhaust from the plurality of cylinders 104 to the atmosphere. For example, the exhaust system 108 may include an exhaust passageway 116, one or more turbines 118 driven by the exhaust flowing through the exhaust passageway 116, a particulate filter device 120 located downstream of the one or more turbines 118, and a reduction device 122 fluidly connected downstream of the particulate filter device 120. It is contemplated that the exhaust system 108 may include different or additional components than described above such as, for example, bypass components, an exhaust compression or restriction brake, an attenuation component, additional exhaust treatment devices, and other known components, if desired.

The one or more turbines 118 may be located to receive exhaust leaving the engine block 102 and/or the plurality of cylinders 104 and may be connected to the one or more compressors 114 of the air induction system 106 by way of a common shaft to form a turbocharger. As the hot exhaust gases exiting the power system 100 move through the turbine(s) 118 and expand against vanes (not shown) thereof, the turbine(s) 118 may rotate and drive the connected compressor(s) 114 to pressurize inlet air.

The particulate filter device 120 may comprise a particulate filter, and is located downstream of the turbine 118 to remove particulates from the exhaust flow of the power system 100. The particulate filter device 120 may include an electrically conductive or non-conductive coarse mesh metal made from a metallic material or porous ceramic honeycomb medium made from a ceramic material. As the exhaust flows through the medium, particulates may be blocked by and left behind in the medium. Over time, the particulates may build up within the medium and, if unaccounted for, could negatively affect engine performance.

To minimize negative effects on engine performance, the collected particulates may be passively and/or actively removed through a process called regeneration. When passively regenerated, the particulates deposited on the filtering medium may chemically react with a catalyst, for example, a base metal oxide, a molten salt, and/or a precious metal that is coated on or otherwise included within particulate filter to lower the ignition temperature of the particulates. The particulate filter device 120 may be closely located downstream of the engine block 102 (e.g., immediately downstream of the one or more turbines 118, in one example). In some examples, the temperatures of the exhaust flow entering the particulate filter device 120 may be high enough, in combination with the catalyst, to burn away the trapped particulates. When actively regenerated, heat may be applied to the particulates deposited on the filtering medium to elevate the temperature thereof to an ignition threshold. For this purpose, an active regeneration device may be located proximal (e.g., upstream of) the particulate filter. The active regeneration device may include, for example, a fuel-fired burner, an electric heater, or any other device known in the art. A combination of passive and active regeneration may be utilized, if desired.

The reduction device 122 may receive exhaust from the one or more turbines 118 and reduce constituents of the exhaust to innocuous gases. In the example shown in FIG. 1, the reduction device 122 is disposed downstream of the particulate filter device 120. In other examples, the particulate filter device 120 may be omitted, and in such examples, a substrate, mesh, filtering medium, or other component of the reduction device 122 may perform the task of physically blocking and/or otherwise capturing particulates included in the exhaust. In any of the examples described herein, the reduction device 122 may embody a selective catalytic reduction (SCR) device that includes one or more treatment units 124. The treatment units 124 may comprise a metal mesh, a ceramic honeycomb medium, and/or any other filtering medium, and in such examples, the filtering medium within the treatment units 124 may be coated with a reduction catalyst selected from any of the catalytic compounds described herein (e.g., a hydrolysis catalyst) to assist with catalytic reduction. In some examples, a gaseous or liquid reductant may be sprayed or otherwise advanced into the exhaust upstream of the one or more treatment units 124. As the reductant is absorbed onto the surface of the one or more treatment units 124, the reductant may react with $NO_X$ (NO and $NO_2$) in the exhaust gas to form water ($H_2O$) and elemental nitrogen ($N_2$). In some embodiments, the catalytic compound(s) disposed on the one or more treatment units 124 is configured to promote even distribution and conversion of urea to ammonia ($NH_3$).

As shown in the enlarged view of FIG. 1, an example treatment unit 124 comprises a filter mesh 130 that a reduction catalyst 132 (e.g., the hydrolysis catalyst described above) is deposited on for the purposes of SCR catalyzation. In particular, one or more of the treatment units 124 are disposed with and/or otherwise supported by a support lattice 128 within the reduction device 122. The support lattice 128 comprises one or more substantially rigid walls that secure and/or otherwise support the filter mesh 130 relative to the flow of exhaust therethrough. More specifically, the support lattice 128 can include a first wall, and a second wall that is disposed substantially parallel to the first wall and spaced from the first wall at a distance D1. Additionally, the support lattice 128 can include a third wall, and a fourth wall that is disposed substantially parallel to the third wall and spaced from the third wall at a distance D2. The first wall, the second wall, the third wall, and the fourth wall can be connected together, in the configuration shown in FIG. 1, via weld joints, secured via fasteners (e.g., screws, bolts, rivets, etc.), and/or be cast to form the support lattice 128. While FIG. 1 depicts a square to represent a cross-sectional area of the treatment units 124, the treatment units 124 can take the form of a cylindrical prism, other cuboids, triangular prisms, hexagonal prisms, and/or other three-dimensional (3D) shapes for optimizing packing within the reduction device 122. Further, the filter mesh 130 can be secured to the four walls of the support lattice 128 such that the filter mesh 130 removes various particulates from the exhaust traversing the treatment units 124. The reduction catalyst 132 can be deposited on the filter mesh 130 such that the gaseous or liquid reductant sprayed or otherwise advanced into the exhaust absorbs onto the reduction catalyst 132 and reacts with pollutant species within the exhaust. In any of the examples described here, the number, type, size, shape, location, spacing, and/or other configurations of the filtration and reduction components within the reduction device 122 can be selected and/or modified to achieve a desired level of exhaust treatment and/or a desired flowrate of exhaust through the reduction device 122 for the power system 100.

The reduction device 122 may also be configured to attenuate sound generated by the engine block 102, the cylinders 104, the compressor(s) 114, the turbine(s) 118, and/or other components of the power system 100. In particular, the power system 100 can be located at and/or associated with a facility that has low ambient sound pressures such that the sound generated by the power system 100 is determined to utilize dampening and/or attenuation that is generally not provided by the reduction device 122. Additionally, utilization of an independent muffler that is installed subsequent to (e.g., downstream from, in series with) the reduction device 122 to accomplish sound dampening and/or attenuation can be undesirable due to the additional expense, space utilization, and other drawbacks associated with such devices. As will be described in greater detail below, in some examples, available volume within a housing of the reduction device 122 enables integration of sound attenuation modules. Accordingly, the reduction device 122 can be configured as a modular system that utilizes attenuation components (e.g., one or more resonators 126, attenuation materials, etc.) and treatment units 124 to accomplish both sound attenuation (e.g., dampening) and exhaust treatment for the power system 100. In any of the examples described here, the number, type, size, shape, location, spacing, and/or other configurations of the attenuation components within the reduction device 122 can be selected and/or modified to achieve a desired level of attenuation and/or to attenuate desired frequencies associated with the power system 100.

With continued reference to FIG. 1, the reduction device 122 includes a housing 134 (e.g., a cylindrical housing, a rectangular housing, etc.) that substantially encloses a volume of space (e.g., an internal volume of the housing 134). In any of the examples described herein, the one or more treatment units 124, as well as the support lattice 128, are disposed within the housing 134 (e.g., disposed within the internal volume). The reduction device 122 also includes one or more resonators 126 disposed within the housing 134 and configured to attenuate sound generated by the power system 100 and/or by the exhaust passing through various components of the power system 100. In particular, the housing 134 and other components of the reduction device 122 are configured such that exhaust from the power system 100 is directed to pass through the treatment units 124 prior to exiting the housing 134. For example, the housing 134 and other components of the reduction device 122 are configured such that exhaust entering the housing 134 is prohibited from exiting the housing 134 without first passing through and/or otherwise traversing one or more of the treatment units 124. In some examples, the resonators 126 disposed within the housing 134 are fluidly sealed relative to the flow of exhaust. In such examples, treated and untreated exhaust is prevented (e.g., due to the fluidly sealed configuration of the one or more resonators 126) from passing over or through the one or more resonators 126 as the exhaust passes through the reduction device 122. Alternatively, as will be described in greater detail below, one or more of the resonators 126 may be exposed to exhaust passing through the reduction device 122. In such examples, however, and regardless of the interaction between the exhaust and the one or more resonators 126 disposed within the housing 134, the housing 134 and other components of the reduction device 122 may still be configured such that exhaust entering the housing 134 is prohibited from exiting the housing 134 without first passing through and/or otherwise traversing one or more of the treatment units 124. Additionally, in any of the examples described herein, one or more of the resonators 126 can be tuned to target specific frequencies and/or ranges of frequencies to broaden the sound attenuation range (e.g., the range of frequencies that can be attenuated by the reduction device 122 as a whole) of the reduction device 122. Accordingly, a primary exhaust channel of the reduction device 122 can be occupied by one or more treatment units 124 that treat the exhaust of the power system 100 while additional space within the reduction device 122 is at least partly occupied by one or more resonators 126.

In some examples, the reduction device 122 is configured such that the housing 134 is a cylindrical housing and the treatment units 124 are cuboid structures that include the reduction catalyst. Additionally, the cylindrical housing 134 can be configured such that the treatment units 124 occupy a cuboid volume within the reduction device 122. Further, the volume of the cylindrical housing 134 not occupied by the treatment units 124 can be utilized to provide sound attenuation for the power system 100. Accordingly, the reduction device 122 can be configured to treat exhaust output by the power system 100 while utilizing the available volume within the housing 134 to provide sound attenuation for the power system 100. Further, the available volume in the housing 134 that is not occupied by the treatment units 124 can be configured to provide sufficient sound attenuation over a range of frequencies such that an additional muffler device is not required for the power system 100. Various example configurations of the reduction device 122, the treatment units 124, the attenuation components (e.g., resonators 126), and other components of the present disclosure will be described in greater detail below with respect to FIGS. 2-8.

Figure 2:
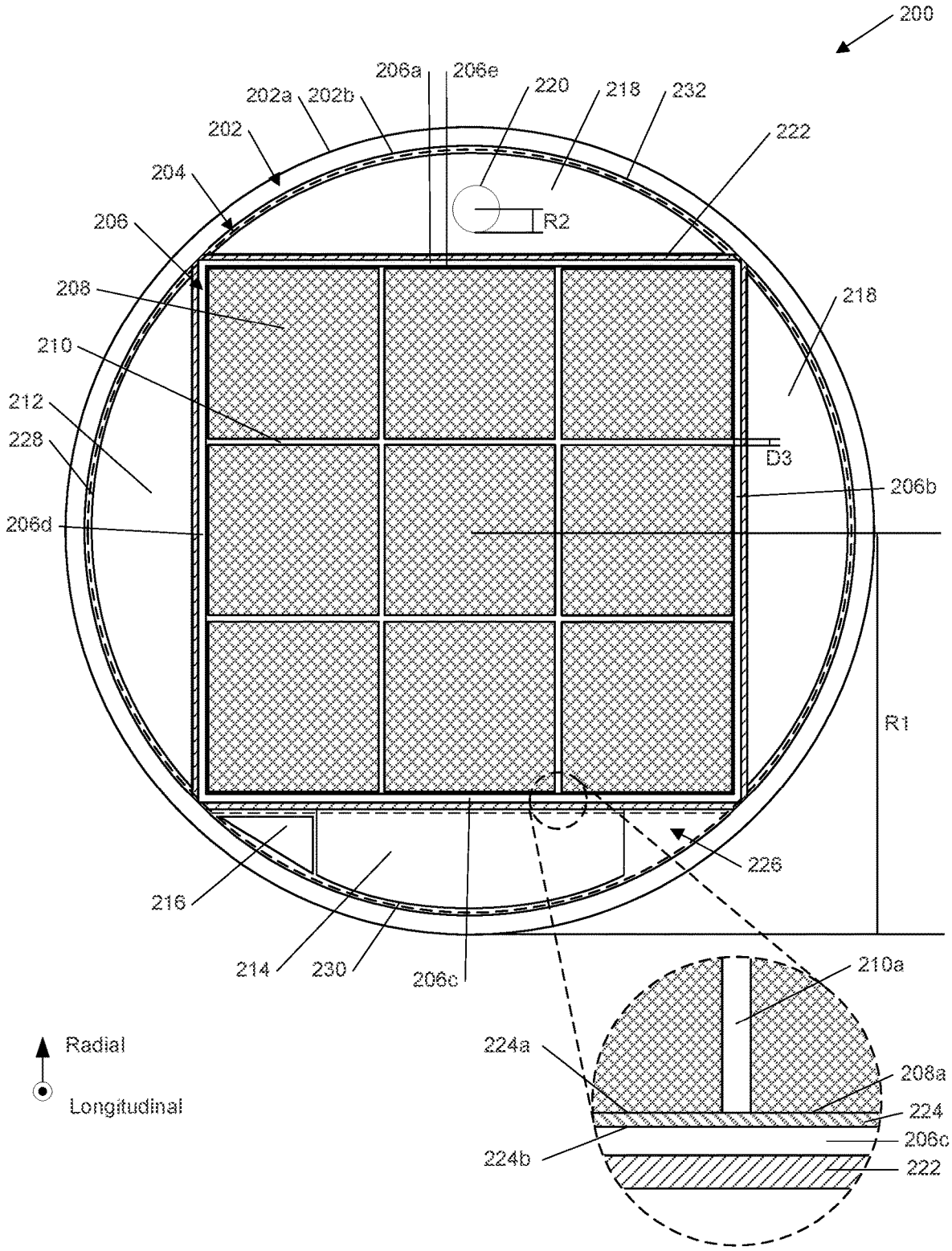
FIG. 2 is a radial cross-sectional illustration of a reduction device that incorporates sound attenuation components in parallel with treatment units according to examples of the present disclosure.

FIG. 2 is a radial cross-sectional illustration of a reduction device 200 that incorporates sound attenuation components in parallel with treatment units. In some examples, the reduction device 200 includes a housing 202, an internal volume 204, an exhaust channel 206, one or more treatment units 208, a support lattice 210, a first resonator 212, a second resonator 214, and attenuation material 216.

In some examples, the housing 202 can be radially outward of the other components of the reduction device 200 and can be configured to provide structural support for the internal components (e.g., exhaust channel 206, one or more treatment units 208, a support lattice 210, a first resonator 212, a second resonator 214, and attenuation material 216). While the housing 202 is depicted as being cylindrical, and as having a substantially circular cross-section, in other examples, the housing 202 may be any three-dimensional (3D) shape that exhaust from a power system can longitudinally traverse from input to output. For instance, in other examples, the housing 202 may be substantially cube-shaped or any other 3D shape, and may have a cross-section that is substantially square, substantially rectangular, substantially hexagonal, and/or or any other two-dimensional (2D) shape. As such, and since the cross-section of the housing 202 can have any 2D shape, the terms "radial" and "radially," as used herein, should not be construed as being applicable only to components, devices, and other items having substantially circular cross-sections. Instead, unless clearly indicated otherwise, the terms "radial" and "radially" refer to directions extending outwardly from a central axis of the respective item, regardless of the cross-sectional shape of the item. Similarly, unless clearly indicated otherwise, the terms "longitudinal" and "longitudinally" refer to directions extending substantially parallel to the central axis of the respective item, regardless of the shape of the item. For example, the housing 202 includes an external surface 202*a* that is radially outward of an inner surface 202*b*, and the internal components of the reduction device 200 can be secured by and/or affixed to the inner surface 202*b* of the housing 202. Further, the housing 202 defines the internal volume 204 for the treatment of power system exhaust and/or for attenuating sounds from the power system.

In some examples, the exhaust channel 206 extends longitudinally along and/or within at least a portion of the internal volume 204 of the housing 202. In such examples, the exhaust channel 206 is, at least in part, in fluid communication with an input of the reduction device 200 and an output of the reduction device 200. Additionally, the one or more treatment units 208 and the support lattice 210 can be disposed within the exhaust channel 206 and supported at least in part by the exhaust channel 206. Further, the exhaust channel 206 can be configured such that exhaust entering the reduction device 200 travels through the exhaust channel 206 before exiting the reduction device 200. In at least one example, the exhaust channel 206 forms a substantially fluid tight seal 222 with the inner surface 202*b* of the housing 202 such that the exhaust is prevented from bypassing the exhaust channel 206. Similarly, in at least one additional example, the exhaust channel 206 forms the substantially fluid tight seal 222 with one or more of the first resonator 212, the second resonator 214, the one or more additional resonators 218 and/or the housing 202. Accordingly, and independent of the specific configuration of the exhaust channel 206, the input and output of the reduction device 200 are in fluid communication with the exhaust channel 206 and the exhaust channel 206 can be configured to prevent untreated exhaust from traversing the reduction device 200 from the input to the output.

In some additional examples of the exhaust channel 206, the input and the output of the reduction device 200 are in fluid communication and enable exhaust to traverse the reduction device 200. For example, the input and the output of the reduction device 200 can be disposed on opposite longitudinal ends of the housing 202. Additionally, the input and the output of the reduction device can be disposed on a first longitudinal surface and a second longitudinal surface (e.g., flat surfaces located on either end of the housing 202 that are perpendicular to the central, longitudinal axis of the reduction device 200) of the housing 202. Alternatively, or in addition, the input and the output of the reduction device can be disposed on a radial surface (e.g., the surface of the reduction device 200 that is at radius R1 from the longitudinal axis) of the reduction device 200.

In some further embodiments of the exhaust channel 206, the exhaust channel 206 includes a first wall 206*a*, a second wall 206*b*, a third wall 206*c*, and a fourth wall 206*d*. In particular, the first wall 206*a* can be substantially parallel to the third wall 206*c* and separated by a vertical distance such that the treatment units 208 are disposed between the first wall 206*a* and the third wall 206*c*. Similarly, the second wall 206*b* can be substantially parallel to the fourth wall 206*d* and separated by a horizontal distance such that the treatment units 208 are disposed between the second wall 206*b* and the fourth wall 206*d*. Additionally, the first wall 206*a*, the second wall 206*b*, the third wall 206*c*, and/or the fourth wall 206*d* can be joined to form the exhaust channel 206. For example, the exhaust channel 206 can be formed from the first wall 206*a*, the second wall 206*b*, the third wall 206*c*, and/or the fourth wall 206*d* via weld joints, fasteners (e.g., screws, bolts, rivets, etc.), and/or casting the exhaust channel 206. Further, the first wall 206*a*, the second wall 206*b*, the third wall 206*c*, and/or the fourth wall 206*d* can be joined together to form a substantially fluid tight channel. In some additional examples, the exhaust channel 206 can include the support lattice 210 comprised of individual lattice legs (e.g., lattice leg 210*a*) that extend between at least two of the first wall 206*a*, the second wall 206*b*, the third wall 206*c*, and/or the fourth wall 206*d* and are joined (e.g., joined at approximately 90 degrees/a right angle) to form individual compartments where the treatment units 208 such that the support lattice includes individual positions where the treatment units 208 are installed.

In some examples, the one or more treatment units 208 can be located within the exhaust channel 206 to treat exhaust traversing the reduction device 200. In particular, the one or more treatment units 208 can be disposed within the exhaust channel 206 such that substantially all exhaust that enters the reduction device passes through at least one of the treatment units 208. Additionally, the support lattice 210 can be configured to secure the treatment units 208 within the exhaust channel 206. For example, the support lattice 210 can include bars, plates, and/or other structures that are welded, fastened, and/or otherwise joined to form a matrix in which the one or more treatment units 208 are disposed. Additionally, the one or more treatment units 208 can be secured within the support lattice via compressive force (e.g., the support lattice 210 is formed such that pairs of lattice legs are secured to apply compressive force to the treatment units 208 and prevent dislocation), fasteners, welds, and/or other components. Further, individual lattice legs of the support lattice 210 can form a substantially fluid tight seal 224, in combination with a treatment unit wall 208*a* of the treatment units 208, with the inner surface of the exhaust channel 206. More specifically, a lattice leg 210*a* of the support lattice 210 and the treatment unit wall 208*a* of a single treatment unit 208 can be in contact with a first seal surface 224*a* of the substantially fluid tight seal 224. Similarly, a second seal surface 224*b* of the substantially fluid tight seal 224 can be in contact with the exhaust channel 206 (e.g., the first wall 206*a*, the second wall 206*b*, the third wall 206*c*, the fourth wall 206*d*, etc.). Accordingly, the one or more treatment units 208 and the support lattice 210 can be placed within the exhaust channel 206 to convert and/or capture pollutant species within the exhaust such that gaseous species exiting the reduction device 200 can be output to atmosphere and prevent untreated exhaust from bypassing the one or more treatment units 208. In at least one example, the distance D can be the thickness of the lattice legs between individual treatment units of the treatment units 208. Additionally, the distance D can be minimized such that the ratio of active cross-sectional area (e.g., the surface area of treatment units 208 within the exhaust channel 206 that is exposed to the flow of exhaust through the reduction device) to total cross-sectional area (e.g., the area of the exhaust channel 206) is maximized and the surface area of the support lattice 210 is minimized.

In some examples, the one or more treatment units 208 can include a treatment unit housing comprised of a first wall (e.g., the treatment unit wall 208*a*), a second wall substantially parallel to the first wall, a third wall, and a fourth wall substantially parallel to the third wall, the first wall and the second wall being connected to the third wall and the fourth wall at substantially right angles. Additionally, the one or more treatment units 208 can include a substrate disposed within the treatment unit housing, the substrate formed from one of a metallic material and a ceramic material, and being configured to remove particulates from the exhaust as the exhaust passes through the treatment unit. The substrate may be configured as a filter mesh, a filtering medium, or other component that performs the task of physically blocking and/or otherwise capturing particulates included in the exhaust. Further, the substrate can include a reduction catalyst such that the gaseous or liquid reductant sprayed or otherwise advanced into the exhaust absorbs onto the reduction catalyst and reacts with pollutant species within the exhaust In some examples, sound attenuation devices and/or components can be installed within the housing 202 and outside of the exhaust channel 206 such that internal volume 204 of the reduction device 200 that would typically remain empty around the exhaust channel 206 can be utilized to assist with sound attenuation. In particular, the first resonator 212 and the second resonator 214 can be selected from various resonators that are configured to attenuate sound generated by a power system associated with the reduction device 200 (e.g., power system 100). For example, the first resonator 212 and the second resonator 214 can be selected from Helmholtz resonators, ¼ wavelength resonators, and/or other resonators that can target a sound frequency or a range of sound frequencies. Additionally, the Helmholtz resonators, the ¼ wavelength resonators, and/or the other resonators can be configured as passive resonators (e.g., resonators that attenuate a set range of frequencies) or semi-active resonators (e.g., resonators that attenuate a range of frequencies that is determined by a modifiable volume within the resonator). In at least one embodiment, the reduction device can also include an active resonator that generates an opposite phase sound wave that attenuates the soundwaves generated by the power system. For example, where a sound wave traversing the reduction device has a trough (e.g., low pressure zone) the active resonator can generate a pressure peak and where the sound wave has a peak the active resonator can generate a trough such that the overall pressure exiting the reduction device 200 is at a constant pressure. Accordingly, the first resonator 212 and the second resonator 214 can be selected from various resonator types and configurations to attenuate sound from the associated power system.

In some additional examples, the first resonator 212 can be selected from a Helmholtz resonator, a ¼ wavelength resonator, or another type of resonator to attenuate sounds within the reduction device 200. In particular, the first resonator 212 can be configured to occupy a portion of the internal volume 204 between the housing 202 and the exhaust channel 206. Additionally, the first resonator 212 can be configured to form the substantially fluid tight seal 222 in combination with the housing 202 and the exhaust channel 206 such that exhaust entering the reduction device 200 is prevented from bypassing the treatment units 208 via the first resonator 212. Further, the first resonator 212 can be exposed to the input of the reduction device 200, the output of the reduction device 200, or to the intra-treatment unit volumes between different radial layers of the treatment units 208 (not illustrated by FIG. 2). Accordingly, the first resonator 212 can be configured such that the gas within the first resonator 212 is substantially similar to the gas within the portion of the reduction device 200 that the first resonator 212 is exposed to. More specifically, the first resonator 212 can encompass a volume of gas that can enter and exit the first resonator 212 via a resonator opening (e.g., an opening for the first resonator corresponding to resonator opening 220 of the additional resonators 218). As will be discussed in greater detail by FIG. 4, the first resonator 212 (and other resonators associated with the reduction device 200) can be configured to be in fluid communication with a portion of the reduction device 200 and isolated from other portions of the reduction device 200 to prevent exhaust from bypassing the treatment units 208. For example, the first resonator 212 can be in fluid communication with the opening of the reduction device 200 and fluidly isolated from the output of the reduction device 200 such that exhaust that enters the first resonator 212 via the opening and exits the first resonator back into the volume of exhaust associated with the opening.

Similarly, the second resonator 214 and additional resonators 218 can be selected from a Helmholtz resonator, a ¼ wavelength resonator, or another type of resonator to attenuate sounds within the reduction device 200. In particular, the second resonator 214 and/or the additional resonators 218 can be configured to occupy a portion of the volume between the exterior housing 202 and the exhaust channel 206. Additionally, the second resonator 214 and/or the additional resonators 218 can be configured to form the substantially fluid tight seal 222 in combination with the exterior housing 202 and the exhaust channel 206, in a manner similar to the first resonator 212, such that exhaust entering the reduction device 200 is prevented from bypassing the treatment units 208 via the resonators. As illustrated by FIG. 2, one of the additional resonators 218 can be configured such that a resonator opening 220 (e.g., an opening for a Helmholtz resonator) is exposed to the volume of space that serves as the input for the reduction device 200. Further, the second resonator 214 and/or the additional resonators 218 can be exposed to the same portion of the reduction device 200 as the first resonator 212. Alternatively, or in addition, the second resonator 214 and/or the additional resonators 218 can be exposed to different portions of the reduction device 200 as the first resonator 212 and the other resonators of the reduction device 200. Accordingly, the first resonator 212, the second resonator 214, and/or the additional resonators 218 can provide sound attenuation via exposure to various portions of the reduction device 200.

In some examples, the first resonator 212, the second resonator 214, and/or the additional resonators 218 can be tuned, selected, and/or otherwise configured based on the audio characteristics of the sound output by an associated power system. In particular, the audio profile of the sound output by the associated power system can be determined based at least on operating characteristics of the power system. For example, the power system can be comprised of a number of cylinders within an engine block, a temperature of the exhaust output by the power system, and an RPM of the power system while operating. Additionally, the power system can be associated with a rated load that includes the anticipated steady state operation characteristics. More specifically, the rated load can be associated with a temperature of the exhaust and an RPM of the power system during long term operation that experiences limited fluctuation. Further, the rated load can be associated with a steady state operation of the power source, wherein the steady state operation of an associated power system is defined by a substantially constant rotations per minute (RPM) of a generator or engine within the power system, a substantially constant power output of the generator, and a substantially constant temperature of the flow of exhaust. Accordingly, the first resonator 212, the second resonator 214, and/or the additional resonators 218 can be configured to attenuate frequencies generated by the power system while the power system is operating at the rated load. It should be noted that by tuning the first resonator 212, the second resonator 214, and/or the additional resonators 218 to the frequencies output by the power system at the rated load can enable more efficient attenuation and greater attenuation of the frequencies than a broader system of resonators.

In some additional examples, the first resonator 212, the second resonator 214, and/or the additional resonators 218 can be configured based on the audio characteristics of the sound output by an associated power system. In particular, the audio profile of the sound output by the associated power system can be determined based at least on operating characteristics of the power system. For example, the power system can be comprised of a number of cylinders within an engine block, a temperature of the exhaust output by the power system, and an RPM of the power system while substantially satisfying a power demand of associated systems (e.g., manufacturing facility systems, computational systems, marine systems, etc.). Additionally, the power system can be associated with an operating range that substantially encompasses potential power output of the power system during use. The operation of the power system can include variable operating characteristics that vary as power demands of the associated systems change. Accordingly, the first resonator 212, the second resonator 214, and/or the additional resonators 218 can be tuned to attenuate a range of frequencies such that sufficient attenuation is provided across the operating range of the power system. It should be noted that individual resonators of the first resonator 212, the second resonator 214, and/or the additional resonators 218 may be configured to provide increased attenuation of sound frequencies output by the power system during a sub-range of the operating range compared to the other resonators within the reduction device 200. Alternatively, or in addition, the first resonator 212, the second resonator 214, and/or the additional resonators 218 may be configured to provide substantially equivalent or proportional attenuation for frequencies output by the power system during substantially all of the operating range. In at least one example, a sub-range of the operating range may be identified as a primary operating range for the power system that is associated with operating characteristics that are more likely to occur compared to operating characteristics of other portions of the operating range. Accordingly, the first resonator 212, the second resonator 214, and/or the additional resonators 218 can be configured such that increased attenuation is provided for frequencies associated with the primary operating range.

In some further examples, and as illustrated by the second resonator 214, a resonator that is tuned to attenuate a specific frequency and/or a range of frequencies may not fully occupy a volume 226 between the housing 202 and the exhaust channel 206 of the reduction device 200. In particular, the second resonator 214 can be configured such that additional volume between the housing 202 and the exhaust channel 206 can be occupied by attenuation materials 216 in addition to the second resonator 214. It should be noted that while the second resonator 214 may occupy a portion of the volume 226 between the housing 202 and the exhaust channel 206, a sealing plate (not illustrated) can be installed such that an input chamber, an output chamber, and/or the intra-treatment unit volume(s) are fluidly isolated and that exhaust that enters the second resonator 214 and/or the volume 226 is prevented from bypassing the treatment units 208. More specifically, sealing plates may be installed such that gaseous species from the input, the output, and the treatment volume of the reduction device 200 are prevented from mixing. Alternatively, or in addition, the volume 226 between the housing 202 and the exhaust channel 206 can be occupied by an additional resonator 218 and/or additional components associated with resonators of the reduction device 200 (e.g., actuators, pistons, motors, etc. for adjusting the configuration of the resonators) in addition to the second resonator 214. In at least one example, the attenuation material 216 can be utilized to occupy a portion of the volume 226 between the housing 202 and the exhaust channel 206 such that the attenuation materials 216 provided vibration dampening, supplementary attenuation, and other related benefits.

It should be noted that "tuning" the various resonators of the reduction device 200 (and other reduction devices discussed herein), refers to modifying the opening, volume, depth, mass, and other variables associated with the resonators to adjust the frequency and/or range of frequencies that are attenuated by the resonators. In its most basic form, the resonant frequency of a rigid cavity can be defined as:

$$f = \frac{v}{2\pi}\sqrt{\frac{A}{V_0 L_{eq}}}$$

It should be noted that f is the resonant frequency of the cavity, v is the velocity of the sound wave, A is the cross-sectional area of the neck/opening of the cavity, $V_0$ is the volume of the cavity, and $L_{eq}$ is the adjusted length of the neck/opening of the cavity. The above equation illustrates the baseline principles that can be utilized to modify the frequency and/or the range of frequencies attenuated by the various resonators (e.g., the first resonator 212, the second resonator 214, the additional resonators 218, etc.). By modifying the volume of the resonators, the area of the opening, the effective neck length, and other variables, the targeted frequencies of the various resonators can be tuned to sound output by the power system associated with the reduction device 200. Additionally, the type of resonator can be selected based on the sound output by the power system as some types of resonators (e.g., Helmholtz resonators, ¼ wavelength resonators, etc.) can provide greater levels of attenuation, broader ranges of frequencies attenuated, and/or other tradeoffs that enable optimization of the attenuation provide by the reduction device 200 to the associated power system. Further, the attenuation provided by the resonator can be configured based on the associated power system at the time of manufacturing such that the reduction device is paired with the power system or the various resonators can be removed, replaced, and/or reconfigured (e.g., semi-active resonators) by a user that is modifying the attenuation provided for the associated power system. Accordingly, the resonators can be substantially permanent fixtures within the reduction device 200 or modular components that can be removed, replaced, and/or adjusted to provide appropriate attenuation for a variety of systems/a system with variable operation.

In some examples, at least one of the resonators can be a Helmholtz resonator that is configured to attenuate a specific frequency and/or a range of frequencies. In particular, the Helmholtz resonator can be configured to attenuate a range of frequencies (or frequency) defined at least in part on a radius R2 (which defines the cross-sectional area of the neck) of the opening for the resonator, the volume of the resonator, and other qualities of the resonator (e.g., masses associated with the resonator, the pressure within the resonator, length of a neck of the resonator, etc.). The radius R2 can extend from a central longitudinal axis of the internal volume 204 (e.g., a substantially spherical volume, a substantially cylindrical volume, a substantially cuboid volume, etc.) of the Helmholtz resonator and be formed by a substantially cylindrical wall that extends from and/or into the Helmholtz resonator. Additionally, the radius R2 extends from the longitudinal axis to the internal surface of the substantially cylindrical wall. Accordingly, the radius R2 and the volume of the resonator can be altered to determine the frequencies (or frequency) that is attenuated by the resonator. Further, the Helmholtz resonator can include a modifiable volume such that the frequency and/or range of frequencies attenuated by the Helmholtz resonator can be adjusted in situ (e.g., semi-active resonator) or by a user during configuration of the reduction device 200.

As noted above, the input and output of the reduction device 200 are in fluid communication with the exhaust channel 206 such that exhaust entering the reduction device 200 passes through both the exhaust channel 206 and the one or more treatment units 208. For example, the substantially fluid tight seal 222 can be formed between the exhaust channel 206 and the first resonator 212, the second resonator 214, and/or the additional resonators 218 such that exhaust entering the housing 202 is substantially prohibited from bypassing the treatment units 208 before exiting the housing 202.

Figure 3:
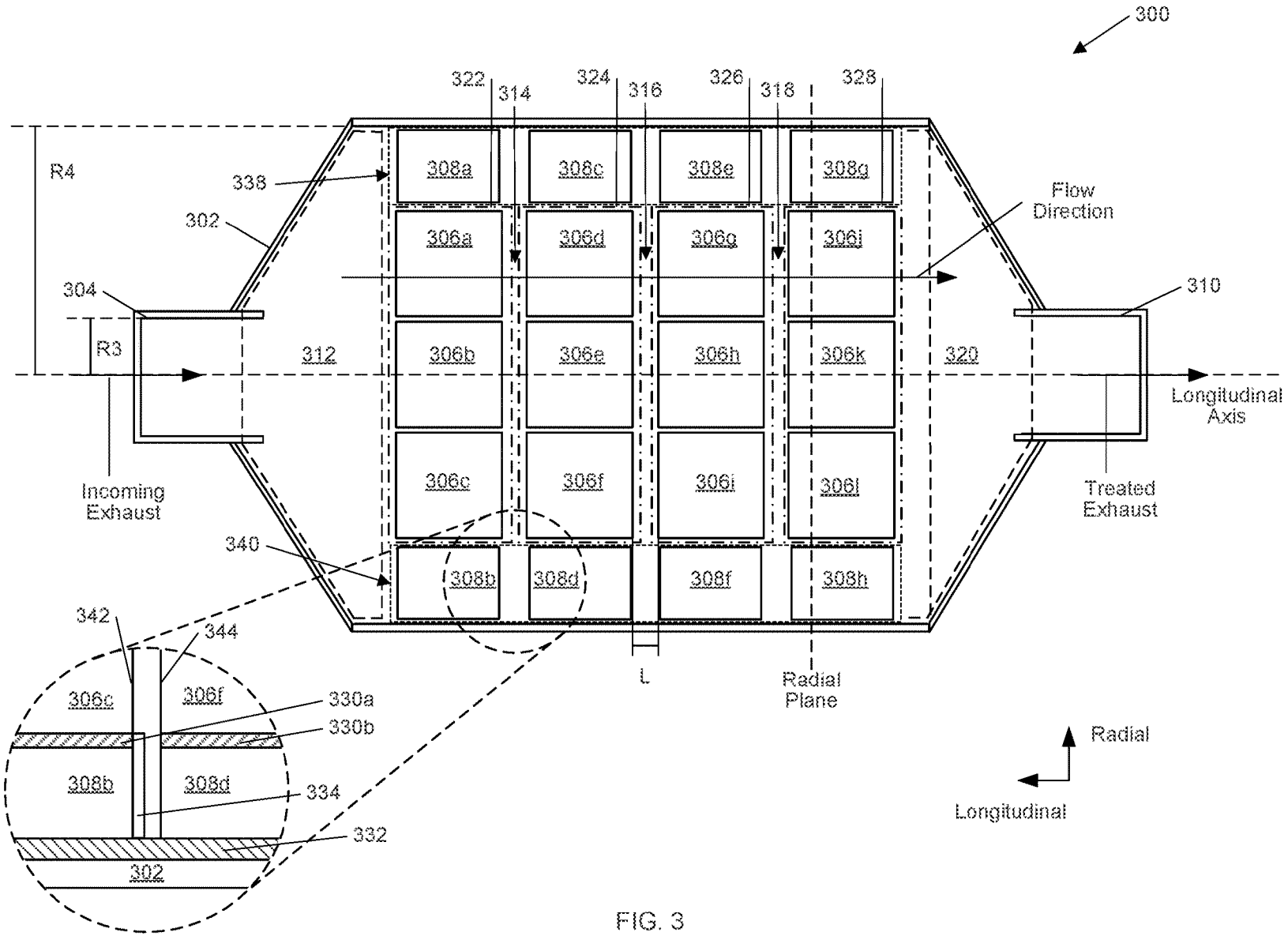
FIG. 3 is a longitudinal cross-sectional illustration of a reduction device that incorporates sound attenuation components in parallel with treatment units according to additional examples of the present disclosure.

FIG. 3 is a longitudinal cross-sectional illustration of a reduction device 300 that incorporates sound attenuation components in parallel with treatment units. In some examples, the reduction device 300 can include a housing 302, an input channel 304, one or more treatment units 306 (e.g., treatment unit 306*a* through treatment unit 306*l*), one or more resonators 308, and an output channel 310. Additionally, the reduction device 300 can include an input chamber 312 that is positioned longitudinally upstream of the treatment units 306, one or more intra-treatment unit volumes (e.g., a first intra-treatment unit volume 314 through a third intra-treatment unit volume 318), and an output chamber 320 that is positioned longitudinally downstream of the treatment units 306. It should be noted that the reduction device 300 can include a housing that substantially similar to that described above with respect to FIG. 2. Further, the treatment units 306*a*-306*l* can be configured in radial layers include a first radial layer 322 (comprising treatment units 306*a*-306*c*), a second radial layer 324 (comprising treatment units 306*d*-306*f*), a third radial layer 326 (comprising treatment units 306*g*-306*i*), and a fourth radial layer 328 (e.g., a fourth radial layer 328 comprised of treatment units 306*j*-306*l*).

In some examples, the input channel 304 can be configured to receive exhaust output by an associated power system (e.g., power system 100). In particular, the input channel 304 can be fluidly connected to the associated power system such that exhaust from the power system is directed to the input channel 304. Alternatively, or in addition, the input channel 304 can be fluidly connected to a plurality of associated power systems such that exhaust is collected from the plurality of power systems and provided to the reduction device via the input channel. Accordingly, the input channel can be a pipe, a tube, and/or other substantially hollow portion of the housing that is configured to receive exhaust from an associated power system and direct the exhaust to the input chamber 312. The input channel can be in fluid communication with the treatment units 306 of the reduction device 300 and the resonators 308 that attenuate sound frequencies within the reduction device 300.

Additionally, the input channel 304 can be fluidly connected to an input chamber 312 that precedes the treatment units 306 and the resonators 308. In particular, the input chamber 312 may be in fluid communication with one or more of the resonators 308 and/or the treatment units 306. Additionally, the resonators 308 in fluid communication with the input chamber 312 can be sealed such that exhaust that enters the resonator(s) 308 is prevented from bypassing the treatment units 306. Further, the treatment units 306 can be porous such that exhaust arriving in the input chamber 312 is forced through the treatment units before entering the first intra-treatment unit volume 314. It should be noted that the input chamber 312 can be defined by the housing 302, the input channel 304, and the resonators 308 such that exhaust is permitted to enter the input chamber 312 via the input channel 304 and exit the input chamber 312 via the treatment units 306.

It should be noted that the input chamber 312 is a volume of space that is encompassed by the housing 302 such that exhaust enters the input chamber 312 from the input channel 304, exhaust exits the input chamber 312 into a first radial layer 322 (comprised of treatment unit 306*a* through treatment unit 306*c*), and the input chamber 312 may be in fluid communication with adjacent resonators (e.g., resonator 308*a* and resonator 308*b*). However, it should be noted that the resonator 308*a* and the resonator 308*b* can be optionally in fluid communication with the input chamber 312 or the first intra-treatment unit volume 314. Additionally, the input chamber 312 can be radially enclosed by a portion of the housing 302 (e.g. a conical portion of the housing 302). In at least one example, the input chamber 312 can be radially enclosed by a conical portion of the housing 302 that expands from a first radius R3 measured from the longitudinal axis of the reduction device 300 to a first interior wall of the housing 302 at the input channel 304 to a second radius R4 measured from the longitudinal axis of the reduction device 300 to a second interior wall of the housing 302 enclosing the treatment units 306 and the resonators 308. Further, the input chamber 312 can be longitudinally bounded by the input channel 304 and the first radial layer 322.

In some examples, the treatment units 306 can be configured to filter particulates out of the exhaust and/or convert pollutant species before emitting treated exhaust to atmosphere. In at least one example, the treatment units 306 can be substantially similar to treatment units 208 as described with respect to FIG. 2. In addition, the treatment units 306 can be configured so that a series of treatment unit layers are arranged to treat exhaust from associated power system(s). For example, each radial layer (e.g., each group of two or more treatment units displayed vertically by FIG. 3) can be configured such that the individual treatment units are sealed to each other along the radial axis (e.g., sealed together by a structure such as the support lattice 210). It should be noted that the treatment units 306 of a radial layer (e.g., treatment units 306*a*-306*c* of the first radial layer 322) can be sealed to other treatment units 306 of the radial layer and/or to resonators 308 that are radially adjacent to the first radial layer 322. For example, the treatment unit 306*c* can be sealed to the resonator 308*b* via a first leg 330*a* of the support lattice 210 and the treatment unit 306*f* can be sealed to the resonator 308*d* via a second leg 330*b* of the support lattice 210. These components can be combined via welds, fasteners, compressive forces applied by the housing 302, and/or other attaching means (e.g., adhesives, interlocking components, etc.). Further, individual legs of the support lattice 210 can form substantially fluid tight seals between the treatment units 306 and/or the resonators 308. Additionally, the treatment units 306 of each radial layer can be in fluid communication with an upstream volume (e.g., the input chamber 312 for the first radial layer 322) immediately upstream of the radial layer (e.g., the first radial layer 322) and a downstream volume (e.g., the first intra-treatment unit volume for the first radial layer 322 or the output chamber 320 for the last radial layer) immediately downstream of the radial layer (e.g., the first radial layer 322). It should be noted that the flow direction arrow of FIG. 3 indicates the flow of exhaust through the reduction device 300 from upstream volumes to downstream volumes. Additionally, it should be noted that the upstream volume and the downstream volume may reference different volumes for each radial layer. Accordingly, each treatment unit 306 within a radial layer can receive gaseous species to be treated from a common upstream volume and output treated gaseous species to a common downstream volume.

In some additional examples, the treatment units 306 can be configured to occupy various 3D volumes within the reduction device 300. For example, the treatment units can be configured to be cuboids, spheres, cylinders, or other 3D shapes that have a cross-sectional area for the exhaust to pass through. Additionally, and based at least on the 3D shape of the treatment units 306, one or more resonators 308 can be positioned between the treatment units 306 within available volume between treatment units that form due to imperfect nesting of shapes. More specifically, while some shapes, such as cuboids and hexagonal prisms can be configured such that there is minimal available volume between individual 3D shapes. Alternatively, or in addition, some shapes, such as cylinders, spheres, and octagonal prisms can be configured such that the available volume between the shapes (e.g., a cuboid volume is outlined by octagonal prisms that are nested in close proximity). Accordingly, based on the shape of the treatment units 306, the available volume between the treatment units 306 can be utilized to place additional resonators within the reduction device 300.

In some further examples, the radial layers of the treatment units 306 can be configured to include one or more resonators 308. In particular, the individual treatment units of a radial layer of treatment units 306 (e.g., treatment units 306*a*-306*c* of the first radial layer 322) can be replaced by one or more resonators 308. For example, the treatment unit 306*b* of the first radial layer 322 can be replaced with an additional resonator (not illustrated). Additionally, the additional resonator can be configured to prevent gaseous species from traversing the first radial layer 322 via the additional resonator through substantially fluid tight seals being formed with the treatment unit 306*a* and the treatment unit 306*c*. The substantially fluid tight seals can be formed similar to the seals formed by the first leg 330*a* and the second leg 330*b* of the support lattice 210 described above. Alternatively, or in addition, the treatment units 306 can be associated with a sealing plate 334 that is connected to an exhaust channel of the reduction device 300 (e.g., exhaust channel 206), one or more treatment units 306 (e.g., treatment unit 306*c*), one or more resonators 308 (e.g., resonator 308*b*), one or more legs of a support lattice (e.g., first leg 330*a* of the support lattice), and/or an inner surface of the housing 302 (e.g., inner surface 202*b*). The sealing plate 334 can be configured to form a substantially fluid tight seal and substantially prohibit the exhaust entering the input chamber 312 from exiting the housing 302 without passing through the treatment units 306. Accordingly, additional attenuation components can be incorporated in the reduction device 300 where the exhaust processing load enables one or more treatment units 306 to be removed from one or more radial layers of the reduction device 300. In at least one additional example, a radial layer can be replaced by a layer of resonators 308. In particular, a radial layer (e.g., the first radial layer 322 or another radial layer within the reduction device 300) can be configured such that individual units of the treatment units 306 within the radial layer are replaced with one or more resonators 308. Additionally, the one or more resonators that are utilized to replace the one or more treatment units 306 can be configured such that exhaust may pass the resonators and continue through the reduction device 300. Accordingly, the reduction device 300 may include a layer of resonators 308 that are placed upstream of, within, and/or downstream of the radial layers of the treatment units 306. For example, an additional resonator can be located in the first intra-treatment unit volume 314 upstream of the second radial layer 324, in the second intra-treatment unit volume 316 downstream of the second radial layer 324, at the position of the treatment unit 306*e* within the second radial layer 324, and/or between the treatment unit 306*d* and the treatment unit 306*e* within the second radial layer 324.

In some examples, resonators 308 can be configured based on the audio characteristics of the sound output by an associated power system. In particular, the audio profile of the sound output by the associated power system can be determined based at least on operating characteristics and/or anticipated operating characteristics of the power system. Additionally, the resonators 308 can be configured in a manner similar to that discussed with reference to FIG. 2 for the first resonator 212, the second resonator 214, and/or the additional resonators 218. For example, the power system can be comprised of a number of cylinders within an engine block, a temperature of the exhaust output by the power system, and an RPM of the power system while operating. Additionally, the frequency (or frequencies) attenuated by the resonators 308 can be configured by adjusting the cross-sectional area of the resonator neck, the volume of the resonators 308, the mass of the resonators 308, and other characteristics of the resonators 308. Accordingly, the resonators 308 can be configured to attenuate frequencies generated by the power system, identified based at least on the operating characteristics of the power system (e.g., the number of cylinders, the exhaust temperature, the RPM of the power system, etc.), by altering the structural characteristics of the resonators 308.

As noted above "tuning" the various resonators of the reduction device 300 (and other reduction devices discussed herein), refers to modifying the opening, volume, depth, mass, and other variables associated with the resonators to adjust the frequency and/or range of frequencies that are attenuated by the resonators. By modifying the internal volume of the resonators, the area of the opening, the effective neck length, and other variables, the targeted frequencies of the various resonators can be tuned to sound wave and frequencies output by the power system associated with the reduction device 300. More specifically, where operating characteristics and/or a range of operating characteristics is known, anticipated, or otherwise associated with the power system, the resonators 308 of the reduction device 300 can be modified and/or configured to provide attenuation for the associated power system during operation at the operating characteristics and/or the range of operating characteristics. Additionally, the type of resonator can be selected based on the sound output by the power system as some types of resonators (e.g., Helmholtz resonators, ¼ wavelength resonators, etc.) can provide greater levels of attenuation, broader ranges of frequencies attenuated, and/or other tradeoffs that enable optimization of the attenuation provide by the reduction device 300 to the associated power system. Further, the attenuation provided by the resonator can be configured based on the associated power system at the time of manufacturing such that the reduction device is paired with the power system or the various resonators can be removed, replaced, and/or reconfigured (e.g., semi-active resonators) by a user that is modifying the attenuation provided for the associated power system.

For example, the associated power system can operate at a rated load that is associated with a number of active cylinders within the power system, a temperature of the exhaust output by the power system, and an RPM of the active cylinders during operation. Based on these operating characteristics, a range of frequencies can be determined for attenuation. The range of frequencies can be utilized to identify resonator types and resonator characteristics (e.g., opening area, internal volume, etc.) to be utilized in attenuating the range of frequencies produced by the power system. Accordingly, appropriate resonators can be manufactured, configured, obtained, and/or installed in the exterior housing of the reduction device 300. Additionally, should the range of frequencies be modified, a user of the system can remove any resonators that are determined to be ineffective for the range of frequencies for replacement and/or reconfiguration in light of the modified range of frequencies through altered internal volumes, effective lengths, cross-sectional areas, and other relevant resonator parameters.

In some additional examples, placement of the resonators 308 can be determined based at least on an attenuation load (e.g., a number of decibels that the sound amplitude is to be reduced by), available volume for resonator placement, and other characteristics of the reduction device 300. In particular, for an associated power system, a reduction device 300 can be configured based at least on a rate of exhaust processing, an attenuation load, and an interior volume of the reduction device. The rate of exhaust processing can represent the amount of exhaust output by the associated power system per unit time and be determined based at least on the rated load, the number of cylinders, the operating range, and/or other operating characteristics of the associated power system. The attenuation load can be determined based at least on the output decibels of the associated power system (e.g., determined based at least on the operating characteristics of the associated power system) and a decibel target that is based at least in part on the ambient noise level within the facility associated with the power system. Accordingly, the number of treatment units is determined based on the rate of exhaust processing associated with the power system. Further, the interior volume of the reduction device 300 can be determined based at least in part on the number of treatment units determined from the rate of exhaust processing. Additionally, the attenuation components are determined for the reduction device 300 based at least on operating characteristics of the associated power system, the attenuation load, the interior volume of the reduction device 300, cost considerations, and/or other characteristics of the reduction device 300 and the associated power system.

In at least one example, the placement of the resonators 308 can be determined based at least on an attenuation load determined based at least on an associated power system and an available volume for resonator placement within the reduction device 300. In particular, the resonators 308 can be configured to occupy a volume of space that is disposed radially around an exhaust channel and/or a matrix of treatment units 306 that are disposed within an exterior housing of the reduction device 300. For example, cuboid treatment units can be configured in a matrix that is three treatment units wide, by three treatment units tall, and four treatment units deep. Additionally, the treatment unit matrix can be encapsulated within a cylindrical exterior housing such that an amount of volume that is not occupied by the treatment units exists between exterior surfaces of the treatment unit matrix and the interior surface of the exterior housing. Accordingly, the available volume for resonator placement can be determined based at least on a first volume 338 between the housing 302 and the treatment units 306 and a second volume 340 between the exterior hull and the treatment units 306. It should be noted that the available volume can include the input channel 304 upstream of the radial layers and/or the output chamber 320 downstream of the radial layers. Further, and based at least on the available volume for resonator placement, resonators can be configured to have resonator characteristics determined to target frequencies output by the associated power system within the operating range of the power system. Accordingly, sufficient resonators to satisfy the attenuation load across a set of frequencies can be configured to occupy the available volume.

In at least one additional example, the placement of resonators 308 can be determined to provide an attenuation amount for a range of frequencies associated with the power system. Additionally, and based at least on the attenuation amount provided by the resonators 308, additional attenuation component(s) can be placed upstream and/or downstream of the reduction device 300 to attenuate the residual attenuation load (e.g., a subset of the attenuation load that is not satisfied by the attenuation components within the reduction device). In particular, the resonators placed within the reduction device 300 can be placed in parallel with the treatment units 306 of the reduction device 300. Additionally, the additional attenuation component(s) can be placed in series with the reduction device 300 to attenuate the residual attenuation load. However, while the residual attenuation for some systems may warrant the additional attenuation components, in some additional applications the residual attenuation may be attenuated via the incorporation of additional resonators upstream and/or downstream of the treatment unit matrix. Accordingly, resonators may be installed in parallel with the treatment units and/or in series with the treatment units to attenuate the attenuation load associated with the power system.

In some further examples, placement of the resonators 308 can be determined based at least on an attenuation load (e.g., a number of decibels that the sound amplitude is to be reduced by), the range of frequencies to be attenuated, and other characteristics of the reduction device 300. In particular, for an associated power system, the resonators 308 can be tuned such that individual resonators are configured to provide more efficient attenuation of specific frequencies and/or sub-ranges of frequencies. Additionally, the tuning of resonators can be accomplished by modifying the cross-sectional area of the opening to the resonator, the internal volume of the resonator, the depth of the resonator, the mass of the resonator, the inclusion of sound attenuating materials within the resonator, and other characteristics of different types of resonators. Accordingly, based on the individual resonator characteristics, the resonators 308 can be placed within the available volume of the reduction device 300. More specifically, larger resonators can be paired with smaller resonators to more efficiently utilize the available volume within the reduction device 300. Further, due to variations in the cross-sectional area in the opening to individual resonators, the configuration of the treatment units 306 can also be modified for placement of the resonators 308. In at least one example, the intra-treatment unit length L can be determined based at least on a resonator opening that is exposed to the first intra-treatment unit volume 314. It should be noted that the intra-treatment unit length L can be measured from the downstream face (e.g., downstream face 342) of a treatment unit (e.g., treatment unit 306*c*) to the upstream face (e.g., upstream face 344) of a second treatment unit (e.g., treatment unit 306*f*). Additionally, the intra-treatment unit length L can vary for different intra-treatment unit volumes. Accordingly, the placement of both treatment units 306 and resonators 308 can be modified within the reduction device 300 to provide attenuation for the range of frequencies output by the power system.

In some examples, the placement of resonators 308 can be substantially in parallel (e.g., placing individual units in at least a single radial plane that extends from the longitudinal axis of the reduction device 300 at least partially within the housing 302 such that at least a portion of treatment unit profiles and resonator profiles overlap on the radial plane) to the placement of the treatment units 306. In particular, placing resonators 308 in parallel with the treatment units 306 can include placing the resonators 308 radially outward of the treatment units 306. More specifically, the resonators 308 can be placed at least partially in one or more planes perpendicular to the longitudinal axis that is shared by the treatment units 306 of one or more radial layers. For example, the resonators 308*a* and 308*b* are placed in parallel with the first radial layer 322 which is comprised of treatment units 306*a*-306*c*, the resonators 308*c* and 308*d* are placed in parallel with the second radial layer 324 comprised of treatment units 306*d*-306*f*, the resonators 308*e* and 308*f* are placed in parallel with the third radial layer 326 comprised of treatment units 306*g*-306*i*, and the resonators 308*g* and 308*h* are placed in parallel with the fourth radial layer 328 comprised of treatment units 306*j*-306*l*. Accordingly, a single vertical line can be drawn through the treatment units of a radial layer that also passes through the resonators that are in parallel with the radial layer. Additionally, the resonators 308 placed in parallel with the treatment units 306 can be in fluid communication with at least an upstream volume or a downstream volume associated with a radial layer (e.g., the input chamber 312 or the first intra-treatment unit volume 314 downstream of the first radial layer 322). Alternatively, or in addition, the resonators 308 can be in fluid communication with a volume that located in a radial plane that is upstream or downstream of the treatment units 306, such as the input chamber 312 and/or the output chamber 320. In at least one additional embodiment, one or more resonators 308 can be placed radially inward of the treatment units 306 of a radial layer. As noted above, a treatment unit 306 (e.g., treatment unit 306*b*, 306*e*, 306*g*, 306*l*, or other treatment unit 306) can be replaced by one or more additional resonators such that the one or more additional resonators are within the radial layer (e.g., the first radial layer 322, the second radial layer 324, etc.) and are optionally radially inward of one or more treatment units (e.g., a resonator that replaces treatment unit 306*b* is radially inward of treatment unit 306*a* and 306*c*).

In some examples, the treatment unit 306*a* includes a first surface facing the input chamber 312 and configured to receive the exhaust from the input chamber 312. Additionally, the treatment unit 306*d* includes a second surface facing the treatment unit 306*a* and configured to receive exhaust from the treatment unit 306*a*. Further, attenuation component (e.g., the resonator 308*a* or the resonator 308*c*) includes a third surface facing the input chamber 312, the third surface being disposed substantially coplanar with the first surface of the treatment unit 306*a* or the second surface of the treatment unit 306*d*. It should be noted that the specific treatment units and specific resonators can refer to any of the treatment units 306*a*-306*l* and any of the resonators 308*a*-308*h*.

In some additional examples, the treatment unit 306*a* includes a first surface facing the input chamber 312 and configured to receive the exhaust from the input chamber 312. Additionally, the treatment unit 306*d* includes a second surface facing the treatment unit 306*a* and configured to receive exhaust from the treatment unit 306*a*. Further, the resonator 308*a* includes a third surface facing the input chamber 312, the third surface being disposed substantially coplanar with the first surface. Additionally, the resonator 308*c* includes a fourth surface facing the resonator 308*a*, the fourth surface being disposed substantially coplanar with the second surface.

As noted above, the reduction device 300 can be configured to receive the exhaust at the input chamber 312 of the housing 302, the input chamber 312 being in fluid communication with the output chamber 320 of the housing 302 via an exhaust channel of the housing 302. The exhaust channel can be an independent structure (e.g., exhaust channel 206) and/or formed via substantially fluid tight seals between the treatment units 306, the resonators 308 (e.g., substantially fluid tight seal 332), one or more sealing plates 334, one or more legs of the support lattice (e.g., the first leg 330*a* and the second leg 330*b*), and the housing 302. More specifically, the substantially fluid tight seals can be configured to prohibit the exhaust entering the housing 302 and the input chamber 312 from bypassing the treatment units 306 before exiting the housing 302 via the output chamber 320. A substantially fluid tight seal 332 can be formed between the resonators 308 and the housing 302 similar to the substantially fluid tight seal formed between the first leg 330*a* and/or the second leg 330*b* of the support lattice, the treatment units 306, and/or the resonators 308. Accordingly, the resonators 308 can attenuate, via placement within the housing 302 and fluid connection to the exhaust channel, a range of frequencies associated with the exhaust. Similarly, the treatment units 306 can remove one or more pollutant species from the exhaust as the exhaust passes through the exhaust channel.

Figure 4:
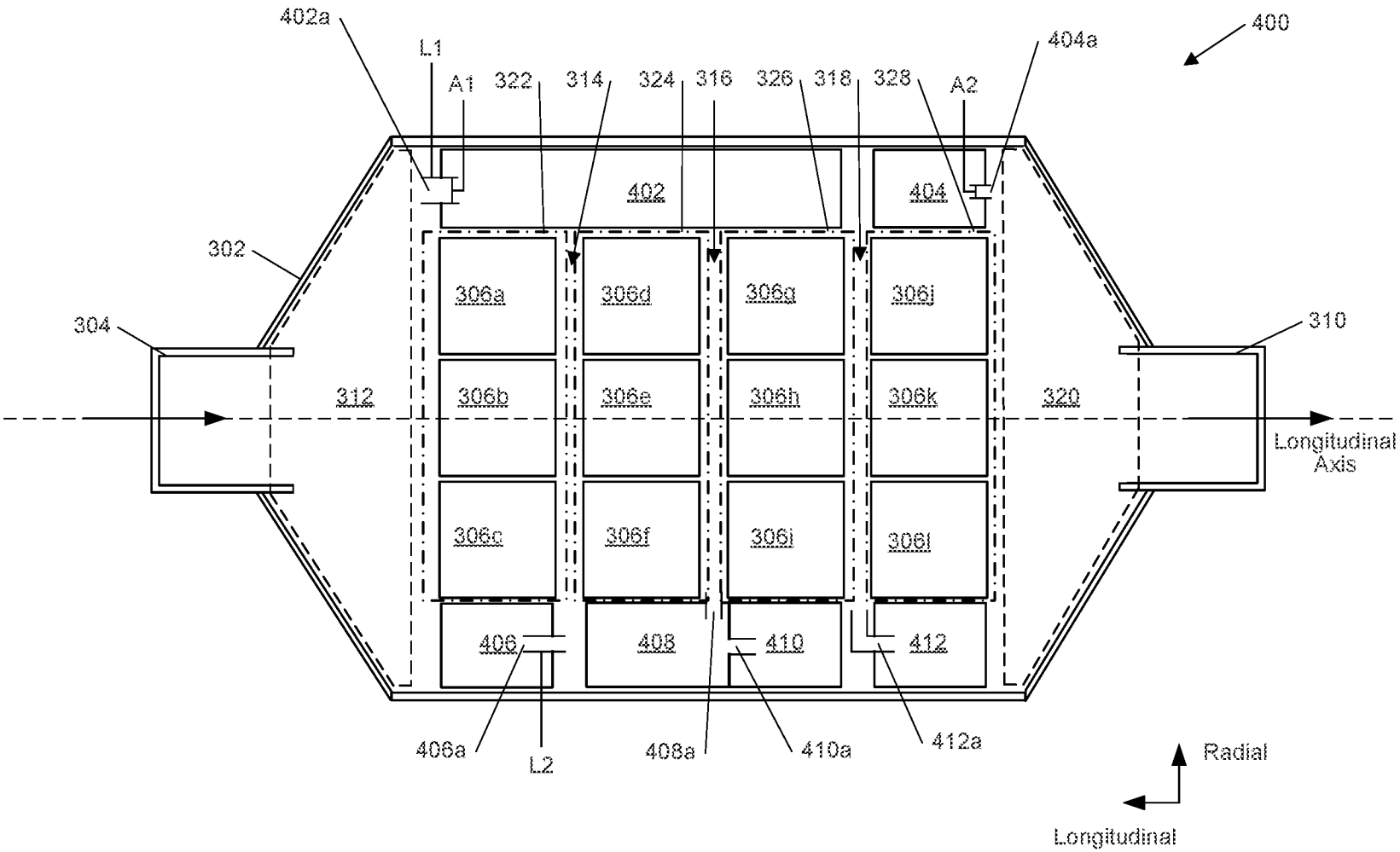
FIG. 4 is a longitudinal cross-sectional illustration of a reduction device that incorporates Helmholtz resonators in parallel with treatment units to further examples of the present disclosure.

FIG. 4 is a longitudinal cross-section illustration of a reduction device that incorporates Helmholtz resonators in parallel with treatment units. In some examples, reduction device 400 can share some components with the reduction device 300 or include additional components different from the reduction device 300 (not illustrated). In particular, the reduction device 400 includes a housing 302, an input channel 304, treatment units 306, and output channel 310. Additionally, the reduction device 400 can include an input chamber 312 that is positioned longitudinally upstream of the treatment units 306, a first intra-treatment unit volume 314, a second intra-treatment unit volume 316, and a third intra-treatment unit volume 318 (e.g., longitudinally disposed volumes between two radial layers of treatment units 306*a*-306*l*), and an output chamber 320 that is positioned longitudinally downstream of the treatment units 306*a*-306*l*. Further, the reduction device 400 can include configured Helmholtz resonators 402, 404, 406, 408, 410, and 412. It should be noted that the Helmholtz resonators 402-412 are fluidly sealed to prevent throughflow from an upstream volume to a downstream volume.

In some examples, a Helmholtz resonator 402 can be configured to attenuate sounds output by a power system associated with the reduction device 400. In particular, the Helmholtz resonator 402 can be configured to extend in the longitudinal direction such that the Helmholtz resonator 402 is configured in parallel with a first radial layer 322, a second radial layer 324, and third radial layer 326 of the reduction device 400. Additionally, the Helmholtz resonator 402 can be configured to include an opening with cross-sectional area A1 and a length L1 of a neck 402*a* associated with the opening of the Helmholtz resonator 402. The cross-sectional area A1 and the length L1 of the neck 402*a* can be determined based at least in part on a range of frequencies to be attenuated by the Helmholtz resonator 402. Further, the Helmholtz resonator 402 can be configured to be in fluid communication with the input chamber 312 of the reduction device 400. In at least one example, and as described above, the Helmholtz resonator 402 can be a passive resonator or a semi-active resonator based at least in part on the operating characteristics of the associated power system. For example, where the power system is associated with a rated load that the power system will commonly operate at, the Helmholtz resonator 402 can be configured to attenuate a range of frequencies associated with the rated load (e.g., statically attenuate the range of frequencies as a passive resonator). Alternatively, or in addition, where the power system is associated with an operating range that the power load can fluctuate within (e.g., a large machine regulation point, a locomotive notch speed, or a marine propeller curve, low idle operation, etc.) the Helmholtz resonator 402 can be configured to attenuate a range of frequencies associated with the power system that may change as the power load fluctuates within the operating range (e.g., the Helmholtz resonator 402 can alter the internal volume of the resonator to modify the attenuated range of frequencies as a semi-active resonator).

In some examples, a Helmholtz resonator 404 can be configured to attenuate sounds output by a power system associated with the reduction device 400. In particular, the Helmholtz resonator 404 can be configured to extend in the longitudinal direction such that the Helmholtz resonator 404 is configured in parallel with a fourth radial layer 328 of the reduction device 400. Additionally, the Helmholtz resonator 404 can be configured to include an opening with cross-sectional area A2 determined based at least in part on a range of frequencies to be attenuated by the Helmholtz resonator 404. Further, the Helmholtz resonator 404 can be configured to be in fluid communication with the output chamber 320 of the reduction device 400 via a neck 404*a*. It should be noted that the cross-sectional area A2 of the neck 404*a* can be different from the cross-sectional area A1 of the neck 402*a* while retaining the length L1 such that a different range of frequencies are attenuated by the Helmholtz resonator 404 due to the variation in the cross-sectional area A2 of the neck 404*a*. In at least one example, the Helmholtz resonator 402 and the Helmholtz resonator 404 can be utilized to provide attenuation for a first range of frequencies associated with the Helmholtz resonator 402 and a second range of frequencies associated with the Helmholtz resonator 404. In particular, the Helmholtz resonator 402 and the Helmholtz resonator 404 can be acoustic cells that utilize unequal volumes, unequal lengths, and/or other unequal characteristics to target different ranges of frequencies to attenuate. Accordingly, utilization of individual resonators having different resonator characteristics can broaden the range of frequencies attenuated by the reduction device 400.

In some examples, a Helmholtz resonator 406 can be configured to attenuate sounds output by a power system associated with the reduction device 400. In particular, the Helmholtz resonator 406 can be configured to extend in the longitudinal direction such that the Helmholtz resonator 406 is configured in parallel with the first radial layer 322 of the reduction device 400. Additionally, the Helmholtz resonator 40 can be configured to include an opening that is associated with a neck 406*a* that has a length L2 determined based at least in part on a range of frequencies to be attenuated by the Helmholtz resonator 406. It should be noted that the length L2 of the neck 406*a* can be different from the length L1 of the neck 402*a* while retaining the cross-sectional area A1 such that a different range of frequencies are attenuated by the Helmholtz resonator 406 due to the variation in the effective length the neck 406*a*. Further, the Helmholtz resonator 406 can be configured to be in fluid communication with the first intra-treatment unit volume 314 of the reduction device 400. In at least one example, the Helmholtz resonator 402 and the Helmholtz resonator 406 can be utilized to provide attenuation for a first range of frequencies associated with the Helmholtz resonator 402 and a third range of frequencies associated with the Helmholtz resonator 406. In particular, the Helmholtz resonator 402 and the Helmholtz resonator 406 can be acoustic cells that utilize unequal opening volumes, unequal opening lengths, and/or other unequal characteristics to target different ranges of frequencies to attenuate. Accordingly, utilization of individual resonators having different resonator opening characteristics can broaden the range of frequencies attenuated by the reduction device 400. Further, the resonator openings may utilize a pipe and/or neck that extends into the internal volume of the Helmholtz resonator for the purpose of tuning the attenuated frequencies.

In some examples, a Helmholtz resonator 408 and Helmholtz resonator 410 can be configured to attenuate sounds output by a power system associated with the reduction device 400. In particular, the Helmholtz resonator 408 can be configured to extend in the longitudinal direction such that the Helmholtz resonator 408 is configured in parallel with the second radial layer 324 of the reduction device 400 and is in fluid communication with both the second intra-treatment unit volume 316 via a neck 408*a* and the Helmholtz resonator 410 via a neck 410*a*. Similarly, the Helmholtz resonator 410 can be configured to extend in the longitudinal direction such that the Helmholtz resonator 410 is configured in parallel with the third radial layer 326 of the reduction device 400, is in fluid communication with the Helmholtz resonator 408 via the neck 410*a* and is in fluid communication with the second intra-treatment unit volume 316 via the neck 410*a* and the neck 408*a*. Additionally, the Helmholtz resonator 408 can be configured to include first opening, via the neck 408*a* to a second intra-treatment unit volume 316 and a second opening to the Helmholtz resonator 410, via neck 410*a*, such that the Helmholtz resonator 410 is in fluid communication with the second intra-treatment unit volume via the Helmholtz resonator 408. Accordingly, Helmholtz resonators 408 and 410 can be configured as a multi-tuned resonator and/or a nested attenuation component that is comprised of multiple tuned chambers. It should be noted that while Helmholtz resonators 408 and 410 are connected longitudinally, in some additional examples, the Helmholtz resonators can be configured to connect radially (e.g., Helmholtz resonator 410 is radially outward from Helmholtz resonator 408), via a combination of radial and longitudinal connections, or via a hybrid radial/longitudinal connection. Further, the combination of connected chambers can be utilized to broaden the range of attenuated frequencies and/or increase the attenuation provided by the resonators (e.g., at least partially overlapping ranges of attenuated frequencies).

In some examples, a Helmholtz resonator 412 can be configured to attenuate sounds output by a power system associated with the reduction device 400. In particular, the Helmholtz resonator 412 can be configured to extend in the longitudinal direction such that the Helmholtz resonator 412 is configured in parallel with the fourth radial layer of the reduction device 400. Additionally, the Helmholtz resonator 412 can be configured to include an opening that includes a neck 412*a* that extends into the third intra-treatment unit volume 318 and fluidly connects the third intra-treatment unit volume 318 of the reduction device 400 with the Helmholtz resonator 412. Accordingly, utilization of individual resonators having different resonator opening characteristics can broaden the range of frequencies attenuated by the reduction device 400.

Figure 5:
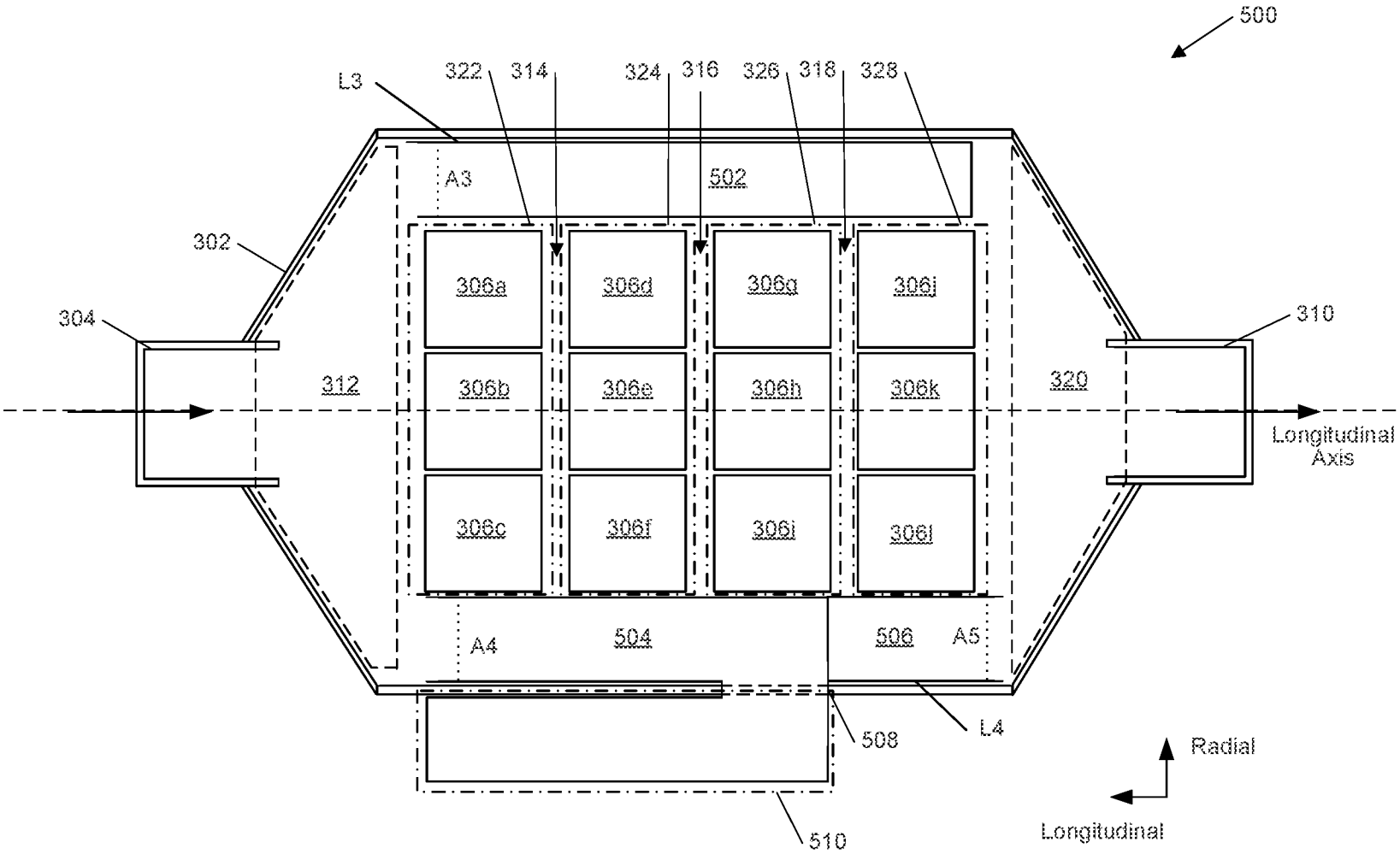
FIG. 5 is a longitudinal cross-sectional illustration of a reduction device that incorporates ¼ wavelength resonators in parallel with treatment units according to other examples of the present disclosure.

FIG. 5 is a longitudinal cross-section illustration of a reduction device that incorporates ¼ wavelength resonators in parallel with treatment units. In some examples, reduction device 500 can share some components with the reduction device 300 or include additional components different from the reduction device 300 (not illustrated). In particular, the reduction device 500 includes a housing 302, an input channel 304, treatment units 306, and output channel 310. Additionally, the reduction device 500 can include an input chamber 312 that is positioned longitudinally upstream of the treatment units 306, a first intra-treatment unit volume 314, a second intra-treatment unit volume 316, and a third intra-treatment unit volume 318 (e.g., longitudinally disposed volumes that are between two radial layers of treatment units 306*a*-306*l*), and an output chamber 320 that is positioned longitudinally downstream of the treatment units 306*a*-306*l*. Further, the reduction device 500 can include configured ¼ wavelength resonators 502, 504, and 506. It should be noted that the ¼ wavelength resonators 502-506 are fluidly sealed to prevent throughflow from an upstream volume to a downstream volume.

In some examples, a ¼ wavelength resonator 502 can be configured to attenuate sounds output by a power system associated with the reduction device 500. In particular, the ¼ wavelength resonator 502 can be configured to extend in the longitudinal direction such that the ¼ wavelength resonator 502 is configured in parallel with a first radial layer 322, a second radial layer 324, a third radial layer 326, and a fourth radial layer 328 of the reduction device 500. Additionally, the ¼ wavelength resonator 502 can be configured to include an opening with a first cross-sectional area A3 and a first length L3 that are determined based at least in part on one or more wavelengths of the sound waves emitted by an associated power system. The one or more wavelengths are associated with a range of frequencies to be attenuated by ¼ wavelength resonator 502 and/or the degree of attenuation to be provided by the ¼ wavelength resonator 502. Further, the ¼ wavelength resonator 502 can be configured to be in fluid communication with the input chamber 312 of the reduction device 500. In at least one example, and as described above, the ¼ wavelength resonator 502 can be a passive resonator or a semi-active resonator based at least in part on the operating characteristics of the associated power system. For example, where the power system is associated with a rated load that the power system will commonly operate at, the ¼ wavelength resonator 502 can be configured to attenuate a range of frequencies associated with the rated load (e.g., statically attenuate the range of frequencies as a passive resonator). Alternatively, or in addition, where the power system is associated with an operating range that the power load can fluctuate within, the ¼ wavelength resonator 502 can be configured to attenuate a range of frequencies associated with the power system that may change as the power load fluctuates within the operating range (e.g., the ¼ wavelength resonator 502 can alter the internal volume of the resonator to modify the attenuated range of frequencies).

In some examples, a ¼ wavelength resonator 504 can be configured to attenuate sounds output by a power system associated with the reduction device 500. In particular, the ¼ wavelength resonator 504 can be configured to extend in the longitudinal direction such that the ¼ wavelength resonator 504 is configured in parallel with the first radial layer 322, the second radial layer 324, and the third radial layer 326 of the reduction device 500. Additionally, the ¼ wavelength resonator 504 can be configured to include an opening with a second cross-sectional area A4, optionally different from the first cross-sectional area A3, and a second length that is determined as an effective length do to the non-linear design of the ¼ wavelength resonator 504. The effective length of the ¼ wavelength resonator 504 can be determined based at least in part on one or more wavelengths associated with a range of frequencies output by the associated power system. Further, the ¼ wavelength resonator 504 can be configured to be in fluid communication with the input chamber 312 of the reduction device 500. In at least one example, the ¼ wavelength resonator 504 can be configured to include a portion that doubles back over a portion or substantially all of the longitudinal length in parallel with the first radial layer 322, the second radial layer 324, and the third radial layer 326 of the reduction device 500. In particular, the length of the ¼ wavelength resonator 504 can be configured to attenuate additional frequencies via an extension of the resonator. As depicted, the ¼ wavelength resonator 504 can extend through a fluid seal 508 that maintains a substantially fluid tight seal such that an external portion 510 of the ¼ wavelength resonator 504 may extend beyond the internal capacity of the exterior housing 302. It should be noted that due to the bend in the ¼ wavelength resonator 504, the second length is an effective second length that is different from a linear measurement of the ¼ wavelength resonator 504 due to the acoustic impact of the bend. In at least one additional embodiment, the ¼ wavelength resonator can fold back on itself within the housing 302 such the external portion 510 of the ¼ wavelength resonator 504 is internal to the exterior housing 302 and forms a double layer resonator where the external portion 510 is disposed radially outward from the treatment units 306 and radially within the housing 302. In particular, where the internal volume of the reduction device 500 provides sufficient space for the ¼ wavelength resonator 504 to double back, the cross-sectional area of the ¼ wavelength resonator 504 can be reduced to enable the placement of the resonator within the housing 302 to extend the effective length of the ¼ wavelength resonator.

In some examples, a ¼ wavelength resonator 506 can be configured to attenuate sounds output by a power system associated with the reduction device 500. In particular, the ¼ wavelength resonator 506 can be configured to extend in the longitudinal direction such that the ¼ wavelength resonator 506 is configured in parallel with the fourth radial layer 328 of the reduction device 500. Additionally, the ¼ wavelength resonator 506 can be configured to include an opening with a third cross-sectional area A5 and a third length determined based at least in part on a range of frequencies to be attenuated by the ¼ wavelength resonator 506. Further, the ¼ wavelength resonator 506 can be configured to be in fluid communication with the output chamber 320 of the reduction device 500.

Figure 6:
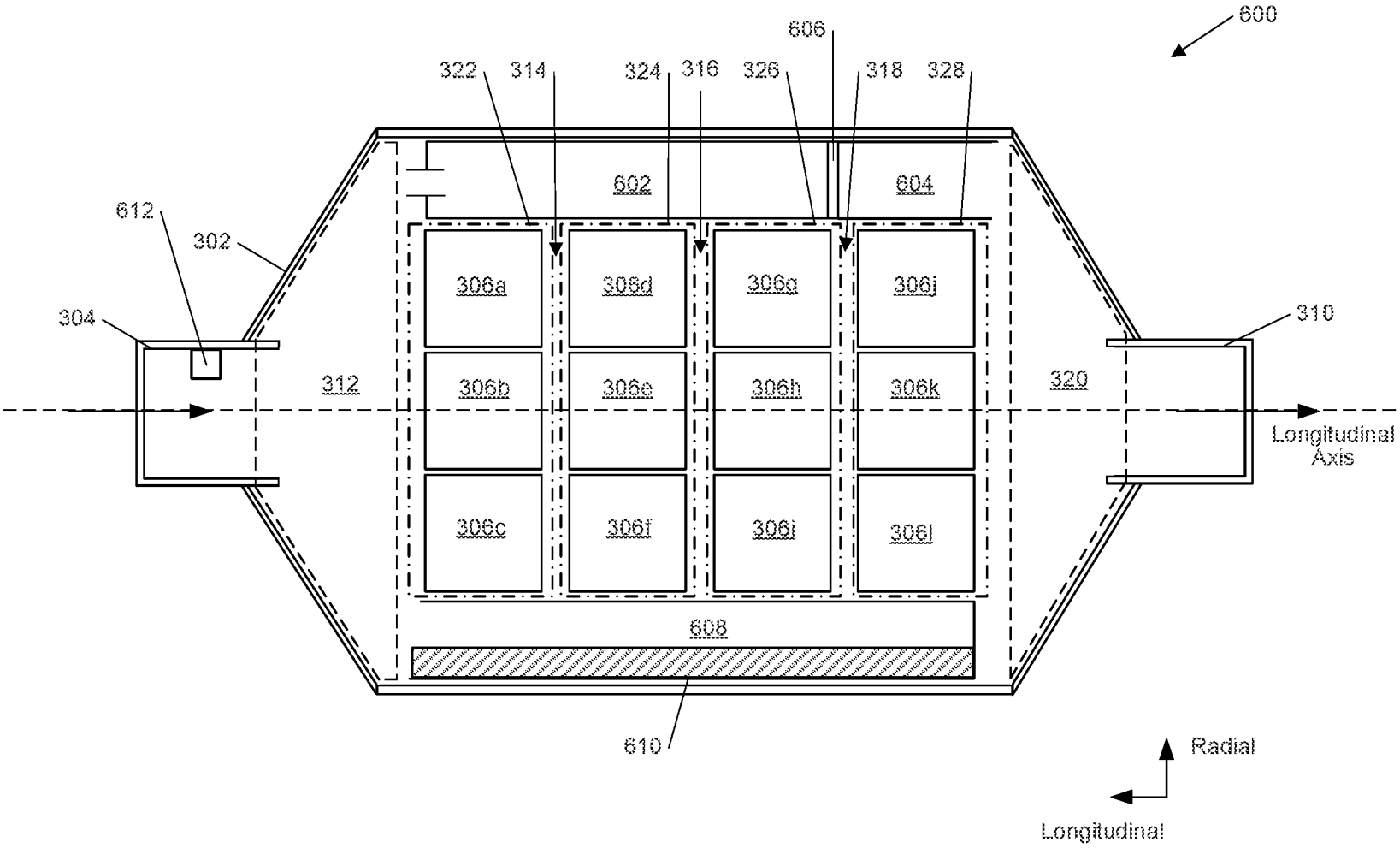
FIG. 6 is a longitudinal cross-sectional illustration of a reduction device that incorporates Helmholtz resonators and ¼ wavelength resonators in parallel with treatment units according to still further examples of the present disclosure.

FIG. 6 is a longitudinal cross-section illustration of a reduction device that incorporates Helmholtz resonators and ¼ wavelength resonators in parallel with treatment units. In some examples, reduction device 600 can share some components with the reduction device 300 or include additional components different from the reduction device 300 (not illustrated). In particular, the reduction device 600 includes a housing 302, an input channel 304, treatment units 306, and output channel 310. Additionally, the reduction device 600 can include an input chamber 312 that is positioned longitudinally upstream of the treatment units 306, a first intra-treatment unit volume 314, a second intra-treatment unit volume 316, and a third intra-treatment unit volume 318 (e.g., longitudinally disposed volumes that are between two radial layers of treatment units 306*a*-306*l*), and an output chamber 320 that is positioned longitudinally downstream of the treatment units 306*a*-306*l*. Further, the reduction device 600 can include configured both Helmholtz resonator 602 and ¼ wavelength resonators 604 and 608. It should be noted that the Helmholtz resonator 602 and the ¼ wavelength resonators 604 and 608 can be fluidly sealed to prevent throughflow from an upstream volume to a downstream volume.

In some examples, a Helmholtz resonator 602 can be configured to attenuate sounds output by a power system associated with the reduction device 600. In particular, the Helmholtz resonator 602 can be configured to extend in the longitudinal direction such that the Helmholtz resonator 602 is configured in parallel with a first radial layer 322, a second radial layer 324, and a third radial layer 326 of the reduction device 600. However, wall 606 of the Helmholtz resonator 602 can be configured to adjust the longitudinal length so that the Helmholtz resonator 602 is configured in parallel with at least one of the first radial layer 322, the second radial layer 324, the third radial layer 326, and/or the fourth radial layer 328 of the reduction device 600. Additionally, the longitudinal dimension of the Helmholtz resonator 602 can be modified based at least on operating parameters associated with the flow of exhaust received by the input channel 304. For example, one or more sensors 612 can be installed in the input channel to detect a flowrate of exhaust, a temperature of exhaust, a pressure amplitude, a frequency associated with pressure variations of the exhaust, and other operation characteristics (potentially associated with the power system itself) to determine resonator parameters for providing sufficient and/or accurate attenuation of sound waves generated by the power system.

In some examples, a ¼ wavelength resonator 604 can be configured to attenuate sounds output by a power system associated with the reduction device 600. In particular, the ¼ wavelength resonator 604 can be configured to extend in the longitudinal direction such that the ¼ wavelength resonator 604 is configured in parallel with the fourth radial layer 328 of the reduction device 600. Additionally, the ¼ wavelength resonator 604 can be modified by the movements of the wall 606, similar to the Helmholtz resonator 602 described above. For example, wall 606 of the ¼ wavelength resonator 604 can be configured to adjust the longitudinal length so that the ¼ wavelength resonator 604 is configured in parallel with at least one of the first radial layer 322, the second radial layer 324, the third radial layer 326, and/or the fourth radial layer 328 of the reduction device 600.

In some examples, a ¼ wavelength resonator 608 can be configured to attenuate sounds output by a power system associated with the reduction device 600. In particular, the ¼ wavelength resonator 608 can be configured to extend in the longitudinal direction such that the ¼ wavelength resonator 608 is configured in parallel with the first radial layer 322, the second radial layer 324, the third radial layer 326, and the fourth radial layer 328 of the reduction device 600. Additionally, the ¼ wavelength resonator 608 can include a dissipative silencer 610 comprised of an attenuating material. More specifically, the ¼ wavelength resonator 608 can include a material that lines one or more interior walls of the ¼ wavelength resonator 608 such that additional attenuation can be provided by the resonator via the absorption of vibrations by the attenuating material. Further, the ¼ wavelength resonator 608 can be configured to be in fluid communication with the input chamber 312 of the reduction device 600. It should be noted that while the illustration of FIG. 6 indicates that only the ¼ wavelength resonator 608 includes the attenuating material 610, the dissipative silencer 610/attenuating material can be installed on interior walls of the exterior housing and/or the resonators and on exterior surfaces of the exterior housing and/or the resonators. Accordingly, providing additional attenuation material can enable the reduction device 600 to offer a greater amount of sound attenuation.

Figure 7:
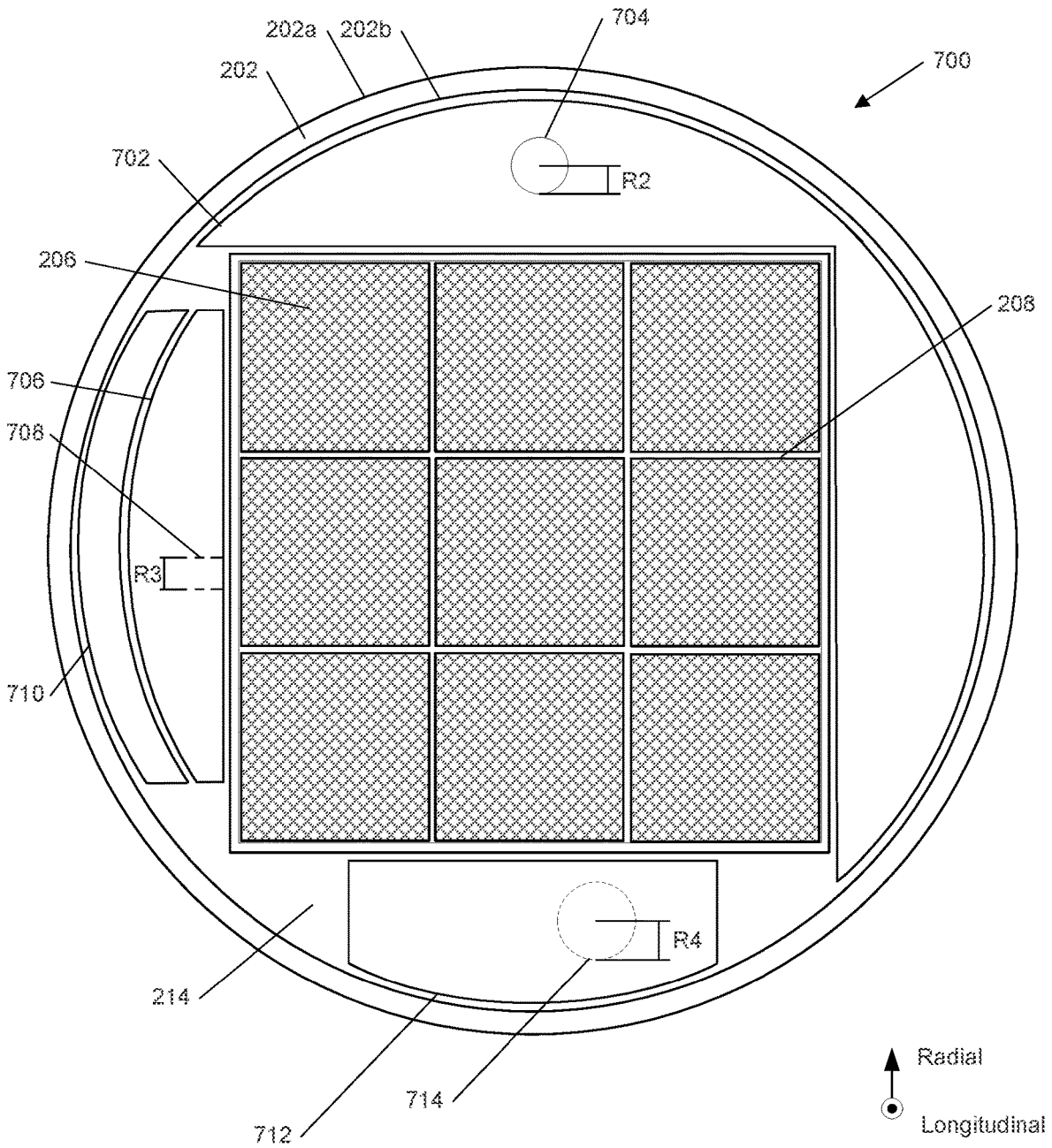
FIG. 7 is a radial cross-sectional illustration of a reduction device that incorporates Helmholtz resonators and/or ¼ wavelength resonators in parallel with treatment units according to additional examples of the present disclosure.

FIG. 7 is a radial cross-section illustration of a reduction device that incorporates Helmholtz resonators and/or ¼ wavelength resonators in parallel with treatment units. In some examples, reduction device 700 can share some components with the reduction device 200 or include additional components different from the reduction device 200 (not illustrated). In particular, the reduction device 700 includes a housing 202, one or more treatment units 208, a support lattice 210, and attenuation material 216. Additionally, the reduction device 700 can include a first Helmholtz resonator 602 with a first opening 704, a second Helmholtz resonator 706 with a second opening 708 and attenuating material 710, and a third Helmholtz resonator 712 with a third opening 714. It should be noted that the Helmholtz resonators 702, 706, and 712 can be fluidly sealed with the housing 202 and the support lattice 210 to prevent throughflow from an upstream volume to a downstream volume.

In some examples, a Helmholtz resonator 702 can be configured to attenuate sounds output by a power system associated with the reduction device 700. In particular, the Helmholtz resonator 702 can be configured to form a substantially fluid tight seal with a top surface of the treatment units 208 and/or a top surface of an exhaust channel (e.g., exhaust channel 206). Additionally, Helmholtz resonator 702 can be configured to form a substantially fluid tight seal with a side surface of the treatment units 208 and/or a side surface of the exhaust channel that is substantially perpendicular to the top surface. It should be noted that the Helmholtz resonator 702 may be configured to form a fluid tight seal with any number of surfaces on the treatment units 208 so long as the flow of exhaust is prevented from bypassing the treatment units 208 and passes through the treatment units while travelling from an exhaust source to an emission point where the cleaned exhaust is output to atmosphere. It should be noted that the Helmholtz resonator 702 may be positioned parallel to any number of radial layers of the reduction device 700. Additionally, the Helmholtz resonator 702 can be configured to include the first opening 704 with cross-sectional area defined by radius R2 that can be determined based at least in part on a range of frequencies to be attenuated by the Helmholtz resonator 702. Further, the Helmholtz resonator 702 can be configured to be in fluid communication with the input chamber 312 of the reduction device 700.

In some examples, a Helmholtz resonator 706 can be configured to attenuate sounds output by a power system associated with the reduction device 700. In particular, the Helmholtz resonator 706 can be configured to form a substantially fluid tight seal with a surface of the treatment units 208 and/or a surface of an exhaust channel (e.g., exhaust channel 206). Additionally, Helmholtz resonator 706 can be configured to form a substantially fluid tight seal such that the attenuating material 710/dissipative silencer does not permit the exhaust to bypass the treatment units 208. It should be noted that the Helmholtz resonator 706 may be configured to form a fluid tight seal on one or more sides of the attenuating material 710 so long as the flow of exhaust is prevented from bypassing the treatment units 208 and passes through the treatment units while travelling from an exhaust source to an emission point where the cleaned exhaust is output to atmosphere. It should be noted that the Helmholtz resonator 706 may be positioned parallel to any number of radial layers of the reduction device 700. Additionally, the Helmholtz resonator 706 can be configured to include the second opening 708 with cross-sectional area defined by radius R3 and a neck that extends into the volume of the Helmholtz resonator from an intra-treatment unit volume or other volume within the housing 202 (not illustrated). Further, the Helmholtz resonator 702 can be configured to be in fluid communication with the input chamber 312 of the reduction device 700. In at least one embodiment, the attenuating material 710 can be incorporated to provide additional attenuation for the reduction device 700. In particular, different attenuation methods can be associated with different amounts of attenuation (e.g., the amount that a sound wave amplitude can be reduced by), different frequency ranges, and other attenuation characteristics. Additionally, the utilization of multiple attenuation methods can enable a more effective solution for attenuating high priority frequencies while maintaining some attenuation for other frequencies that may be less intrusive, less commonly output, or otherwise not prioritized. Accordingly, the attenuating material 710 can be incorporated to improve the attenuation performance of the reduction device 700.

In some examples, a Helmholtz resonator 712 can be configured to attenuate sounds output by a power system associated with the reduction device 700. In particular, the Helmholtz resonator 712 can be configured to form a substantially fluid tight seal with a surface of the treatment units 208 and/or a surface of an exhaust channel (e.g., exhaust channel 206). It should be noted that the Helmholtz resonator 712 may be configured to form a fluid tight seal with any number of surfaces on the treatment units 208 so long as the flow of exhaust is prevented from bypassing the treatment units 208 and passes through the treatment units while travelling from an exhaust source to an emission point where the cleaned exhaust is output to atmosphere. It should be noted that the Helmholtz resonator 702 may be positioned parallel to any number of radial layers of the reduction device 700. Additionally, the Helmholtz resonator 712 can be configured to include an asymmetric opening with cross-sectional area defined by radius R4 that can be determined based at least in part on a range of frequencies to be attenuated by the Helmholtz resonator 712. Further, the Helmholtz resonator 702 can be configured to be in fluid communication with the input chamber 312 of the reduction device 700. In at least some embodiments, the opening to the Helmholtz resonator can be an asymmetrical opening based at least on available space with the reduction device 700, based at least on the position of other attenuation components within the reduction device 700, and/or other structural/acoustic considerations that may indicate that offsetting the third opening 714 from a central, longitudinal radius of the Helmholtz resonator 712 provides a benefit to the reduction device 700.

Figure 8:
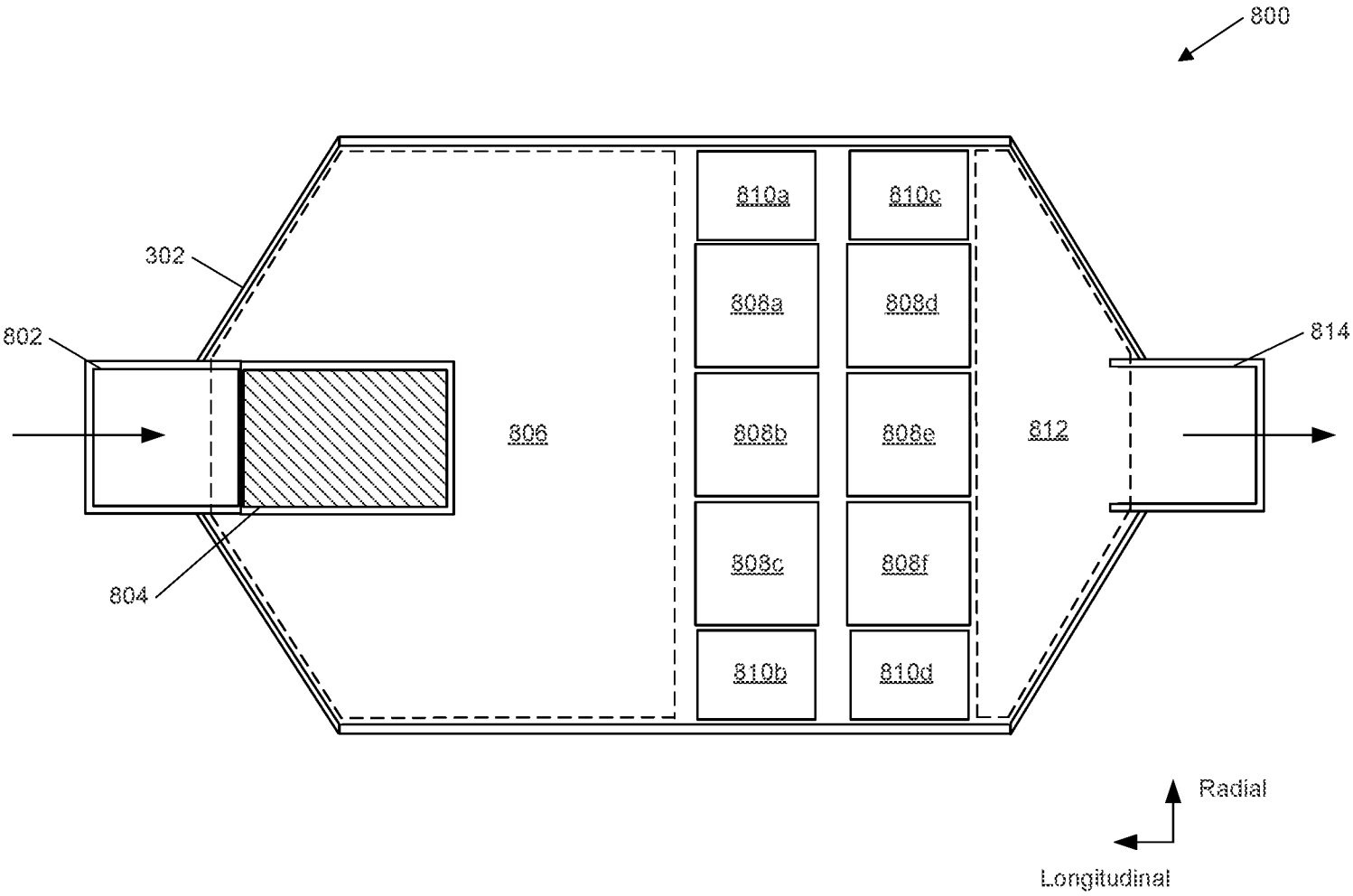
FIG. 8 is a longitudinal cross-sectional illustration of a configurable reduction device that incorporates sound attenuation components in parallel and in series with treatment units according to still other examples of the present disclosure.

FIG. 8 is a longitudinal cross-section illustration of a configurable reduction device that incorporates sound attenuation components in parallel and in series with treatment units. In some examples, the configurable reduction device 800 can include a housing 302, an input channel 802, an in-series attenuation component 804, a configurable input chamber 806, treatment units 808, configurable resonators 810*a*-810*d*, an output chamber 812, and an output channel 814.

It should be noted that input channel 802 and output channel 814 can be substantially similar to the above discussions of input channels and output channels.

In some examples, a configurable reduction device 800 can be configured to incorporate the in-series attenuation component 804 that is associated with the input channel 802 and/or the output channel 814. In particular, there may be scenarios where the configurable resonators 810*a*-810*d* that are positioned in parallel with the treatment units 808 do not satisfy the attenuation threshold for an associated power system. Additionally, the configurable resonators 810*a*-810*d* can provide an amount of attenuation that reduces the amplitude and/or decibels of the sound waves such that a residual attenuation is to be applied to satisfy the attenuation threshold for the power system. Accordingly, the in-series attenuation component 804 can be installed in series with the treatment units 808, either upstream (illustrated) or downstream (not illustrated) to accomplish the residual attenuation. It should be noted that the in-series attenuation component 804 that is in series with the treatment units 808 would have a smaller attenuation capacity compared to an independent attenuation component that is configured to satisfy the attenuation threshold without the assistance of the configurable resonators 810*a*-810*d*.

In some examples, the configurable input chamber 806 can be modified based at least on the flowrate of exhaust generated by an associated power system. In particular, the configurable reduction device 800 is a system that may be modified for utilization with a range of power systems. More specifically, the internal components of the configurable reduction device 800 can be removed from or inserted into the configurable input chamber 806 to treat an anticipated flowrate of exhaust generated by a power system before the treated exhaust is emitted to atmosphere and/or other output. Accordingly, based at least on an operating range, individual radial arrays of treatment units 808 and the configurable resonators 810*a*-810*d* can be added or removed from the configurable input chamber based on the operational range and characteristics of the associated power system. Further, for a high exhaust power system, substantially all of the available configurable input chamber can be filled with radial arrays of treatment units 808 and the configurable resonators 810*a*-810*d*. Alternatively, or in addition, the output chamber 812 can be a configurable output chamber 812 that radial arrays of treatment units 808 and the configurable resonators 810*a*-810*d* are added to and removed from based on the operational characteristics of the associated power system.

Figure 9:
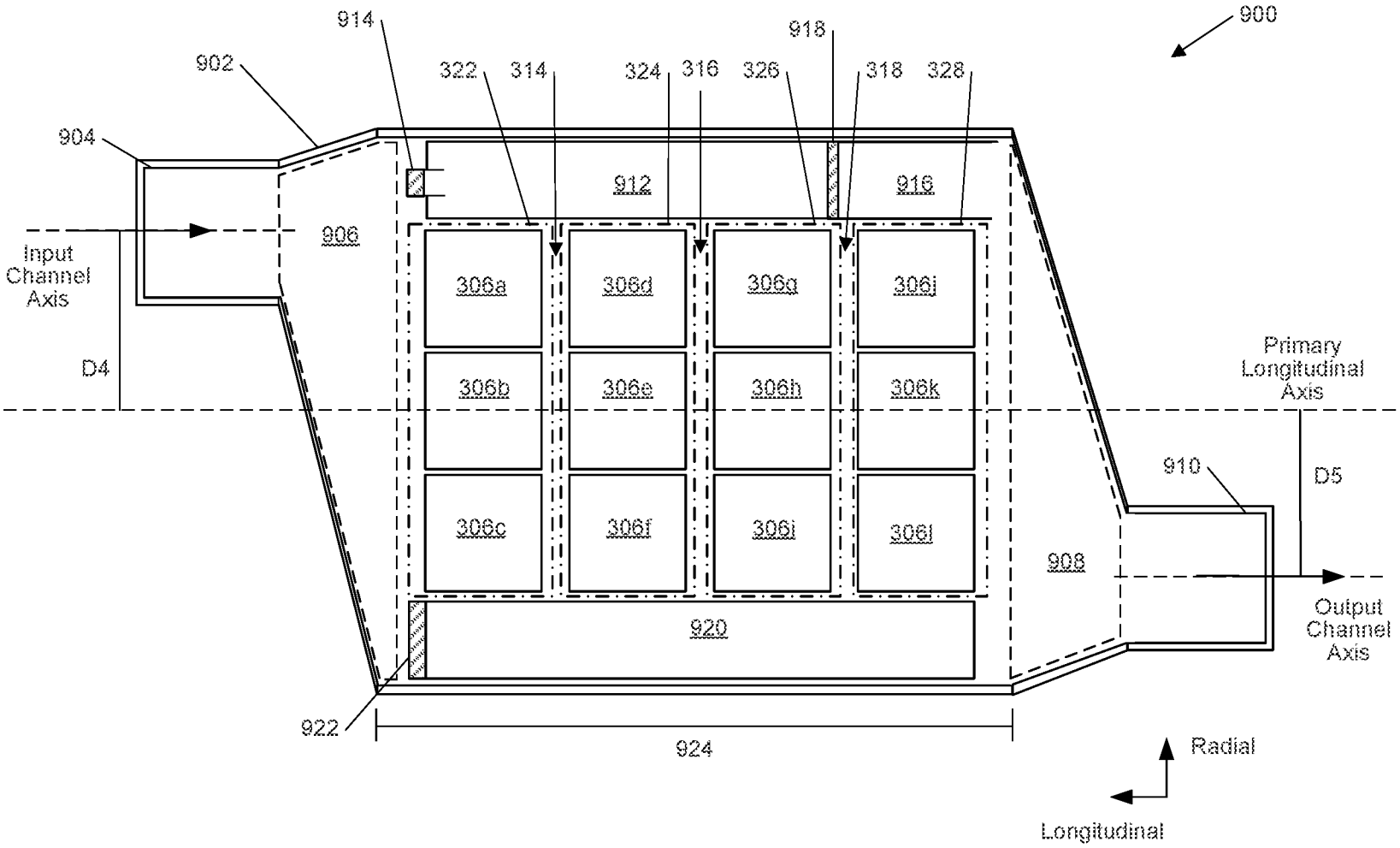
FIG. 9 is a longitudinal cross-sectional illustration of alternate configurations for a reduction device that incorporates sound attenuation components in parallel with treatment units according to additional examples of the present disclosure.

FIG. 9 is a longitudinal cross-sectional illustration of a reduction device 900 that incorporates sound attenuation components in parallel with treatment units. In some examples, the reduction device 900 can include a housing 902, an input channel 904, an input chamber 906, an output chamber 908, an output channel 910, a Helmholtz resonator 912, a resonator opening 914, a ¼ wavelength resonator 916, a wall 918, a ¼ wavelength resonator 920, and an acoustically porous wall 922. In some additional examples, the reduction device 900 can share some components with the reduction device 300 or include additional components different from the reduction device 300 (not illustrated). In particular, the reduction device 900 can include treatment units 306*a*-306*l*, a first intra-treatment unit volume 314, a second intra-treatment unit volume 316, and a third intra-treatment unit volume 318 (e.g., longitudinally disposed volumes that are between two radial layers of treatment units 306*a*-306*l*), a first radial layer 322, a second radial layer 324, a third radial layer 326, and a fourth radial layer 328. Additionally, the input chamber 906 is positioned longitudinally upstream of the treatment units 306*a*-306*l*, one or more intra-treatment unit volumes (e.g., a first intra-treatment unit volume 314 through a third intra-treatment unit volume 318), and the output chamber 908 that is positioned longitudinally downstream of the treatment units 306*a*-306*l*.

In some examples, the input channel 904 can be configured to receive exhaust output by an associated power system (e.g., power system 100). In particular, the input channel 904 can be fluidly connected to the associated power system such that exhaust from the power system is directed through the input channel 904 into the input chamber 906. Alternatively, or in addition, the input channel 904 can be fluidly connected to a plurality of associated power systems such that exhaust is collected from the plurality of power systems and provided to the reduction device 900 via the input channel 904. Additionally, the input channel 904 can be a pipe, a tube, and/or other substantially hollow portion of the housing 902 that is configured to receive exhaust from an associated power system, direct the exhaust to the input chamber 906, and has a substantially central input channel axis. Further, the input channel 904 can be positioned such that the input channel axis is offset by a distance D4 from the primary longitudinal axis of the reduction device 900. It should be noted that the primary longitudinal axis is disposed substantially central to the primary body 924 of the reduction device 900 that houses the treatment units 306*a*-306*l* and the resonators (e.g., the Helmholtz resonator 912, the ¼ wavelength resonator 916, the ¼ wavelength resonator 920, and/or any additional attenuation components). The distance D4 can be measured from the input channel axis to the primary longitudinal axis of the reduction device 900. Accordingly, the input channel 904 can be configured to input exhaust from any position on the upstream portion of the reduction device 900. This can include one or more walls of the housing 902 that are disposed on the upstream portion of the reduction device 900 that enclose the input chamber 906.

Additionally, the input channel 904 can be fluidly connected to an input chamber 906 that precedes the treatment units 306*a*-306*l*, the Helmholtz resonator 912, the ¼ wavelength resonator 916, the ¼ wavelength resonator 920, and/or any additional attenuation components. In particular, the input chamber 906 may be in fluid communication with the Helmholtz resonator 912, the ¼ wavelength resonator 920, any additional attenuation components, and/or the treatment units 306*a*-306*l*. Additionally, the Helmholtz resonator 912, the ¼ wavelength resonator 920, and/or any additional attenuation components in fluid communication with the input chamber 906 can be substantially sealed such that exhaust entering the Helmholtz resonator 912, the ¼ wavelength resonator 920, and/or the additional attenuation components is substantially prevented from bypassing the treatment units 306*a*-306*l*. It should be noted that the input chamber 906 is defined by the housing 902, the input channel 904, the treatment units 306*a*-306*l*, the Helmholtz resonator 912, the ¼ wavelength resonator 920, and/or any additional resonators such that the exhaust is permitted to enter the input chamber 906 via the input channel 904 and exit the input chamber 906 via the first radial layer 322 of the treatment units 306.

In some examples, after passing through the treatment units 306*a*-306*l*, the exhaust enters the output chamber 908. Similar to the input chamber 906, the output chamber 908 can be downstream of the treatment units 306*a*-306*l* and is in fluid communication with the output channel 910, the treatment units 306*a*-306*l*, the ¼ wavelength resonator 916, and/or any additional attenuation components within the housing 902. Additionally, the ¼ wavelength resonator 916 and/or any additional attenuation components in fluid communication with the output chamber 908 can be substantially sealed such that exhaust entering the ¼ wavelength resonator 916 and/or the additional attenuation components is substantially prevented from bypassing the treatment units 306*a*-306*l*. It should be noted that the output chamber 908 is defined by the housing 902, the output channel 910, the treatment units 306*a*-306*l*, the ¼ wavelength resonator 916, and/or any additional resonators such that the exhaust is permitted to enter the output chamber 908 via the fourth radial layer of the treatment units and exit the output chamber 908 via the output channel 910.

In some examples, the output channel 910 can be configured to output exhaust received from and treated by the treatment units 306*a*-306*l*. In particular, the output channel 910 can be fluidly connected to the treatment units 306*a*-306*l* via the output chamber 908 such that treated exhaust from the power system is directed from the output chamber 908, through the output channel 910, and output to an external environment such as the atmosphere. Similar to the input channel 904, the output channel 910 can be a pipe, a tube, and/or other substantially hollow portion of the housing 902 that is configured to receive the treated exhaust from the treatment units 306*a*-306*l* via the output chamber 908 and has a substantially central output channel axis. Further, the output channel 910 can be positioned such that the output channel axis is offset by a distance D5 from the primary longitudinal axis of the reduction device 900. It should be noted that the primary longitudinal axis is disposed substantially central to the primary body 924 of the reduction device 900 that houses the treatment units 306*a*-306*l* and the resonators (e.g., the Helmholtz resonator 912, the ¼ wavelength resonator 916, the ¼ wavelength resonator 920, and/or any additional attenuation components). The distance D5 can be measured from the output channel axis to the primary longitudinal axis of the reduction device 900. Accordingly, the output channel 910 can be configured to output exhaust from any position on the downstream portion of the reduction device 900. This can include one or more walls of the housing 902 that are disposed on the downstream portion of the reduction device 900 that enclose the output chamber 908.

In some examples, the Helmholtz resonator 912 can be configured such that it includes one or more acoustically porous walls such that the Helmholtz resonator 912 is configured to provide sound attenuation while substantially preventing the exhaust from bypassing the treatment units 306*a*-306*l*. As noted above, the Helmholtz resonator 912 can be configured to attenuate a specific frequency and/or a range of frequencies. In particular, the Helmholtz resonator can be configured to attenuate a range of frequencies (or frequency) defined at least in part on a cross-sectional area of a neck of the Helmholtz resonator 912, the volume of the Helmholtz resonator 912, and other attributes of the Helmholtz resonator 912 (e.g., mass associated with the resonator, the pressure within the resonator, length of the neck of the resonator, etc.). Accordingly, individual attributes (e.g., the cross-sectional area, the internal volume, the mass, etc.) of the Helmholtz resonator 912 can be altered to determine the frequencies (or frequency) that is attenuated by the Helmholtz resonator 912. Further, the Helmholtz resonator 912 can include a modifiable volume such that the frequency and/or range of frequencies attenuated by the Helmholtz resonator 912 can be adjusted in situ (e.g., semi-active resonator) or by a user during configuration of the reduction device 900.

In some additional examples, the Helmholtz resonator 912 can include a resonator opening 914 that includes a wall of the Helmholtz resonator 912 that is acoustically porous and enables attenuation to be provided by the Helmholtz resonator 912 via acoustic communication with the input chamber 906, the output chamber 908, and/or the intra-treatment unit volumes. In particular, the resonator opening 914 can utilize open space that exposes the internal volume of the Helmholtz resonator 912 to the exhaust within the input chamber 906, the output chamber 908 (not illustrated), and/or the intra-treatment unit volumes (e.g., the first intra-treatment unit volume 314, the second intra-treatment unit volume 316, the third intra-treatment unit volume 318, etc.). Alternatively, or in addition, the resonator opening 914 can utilize acoustically porous wall configurations that enable attenuation to be provided by the Helmholtz resonator 912 while substantially preventing and/or partially restricting substantial exhaust flow into and out of the Helmholtz resonator 912. For example, the resonator opening 914 can be a wall of the Helmholtz resonator 912 that would otherwise enclose the Helmholtz resonator 912 and includes perforations, micro-perforations, a plurality of holes, and/or other features that enable sound waves to interact with the Helmholtz resonator 912 and the Helmholtz resonator 912 to provide attenuation within the reduction device 900. It should be noted that the resonator opening can be configured such that the acoustically porous wall can optionally enable the internal volume of the Helmholtz resonator 912 to be in fluid communication with the exhaust (e.g., the input chamber 906, the output chamber 908, the intra-treatment unit volumes, etc.), partially restrict fluid communication with the exhaust, and/or substantially prevent fluid communication with the exhaust while providing attenuation. In at least one example, the resonator opening 914 can be configured as the open space or the acoustically porous wall while the wall 918 of the Helmholtz resonator 912 is configured as an additional acoustically porous wall. In particular, the resonator opening 914 and the wall 918 can be configured to substantially restrict exhaust from bypassing the treatment units 306*a*-306*l* while remaining acoustically porous. It should be noted that while the wall 918 is illustrated as in contact with ¼ wavelength resonator 916, the wall 918 can enable acoustic communication with the output chamber 908, a resonator within the housing 902, a resonator outside of the housing 902, and/or the intra-treatment unit volumes.

In some examples, the ¼ wavelength resonator 920 can include an acoustically porous wall 922 that enables the ¼ wavelength resonator 920 to provide attenuation via acoustic communication with the input chamber 906, the output chamber 908, and/or the intra-treatment unit volumes. In particular, the acoustically porous wall 922 can enable attenuation to be provided by the ¼ wavelength resonator 920 while substantially preventing and/or partially restricting substantial exhaust flow into and out of the ¼ wavelength resonator 920. For example, the acoustically porous wall 920 can be a wall of the ¼ wavelength resonator 920 that would otherwise enclose the ¼ wavelength resonator 920 and includes perforations, micro-perforations, a plurality of holes, and/or other features that enable sound waves to interact with the ¼ wavelength resonator 920 and the ¼ wavelength resonator 920 to provide attenuation within the reduction device 900. It should be noted that the resonator opening can be configured such that the acoustically porous wall 922 can optionally enable the internal volume of the ¼ wavelength resonator 920 to be in fluid communication with the exhaust (e.g., the input chamber 906, the output chamber 908, the intra-treatment unit volumes, etc.), partially restrict fluid communication with the exhaust, and/or substantially prevent fluid communication with the exhaust while providing attenuation. In at least one example, acoustically porous wall 922 can be paired with an additional acoustically porous wall of the ¼ wavelength resonator 920. In particular, the acoustically porous wall 922 and the additional acoustically porous wall can be configured to substantially restrict exhaust from bypassing the treatment units 306*a*-306*l* while remaining acoustically porous to different portions of the reduction device 900. It should be noted that the acoustically porous wall 922 and/or the additional acoustically porous wall can be configured such that are in communication with any combination of the input chamber 906, the output chamber 908, and/or the intra-treatment unit volumes (including individual intra-treatment unit volumes and/or multiple-intra-treatment unit volumes depending on the configuration of the resonator).

Figure 10:
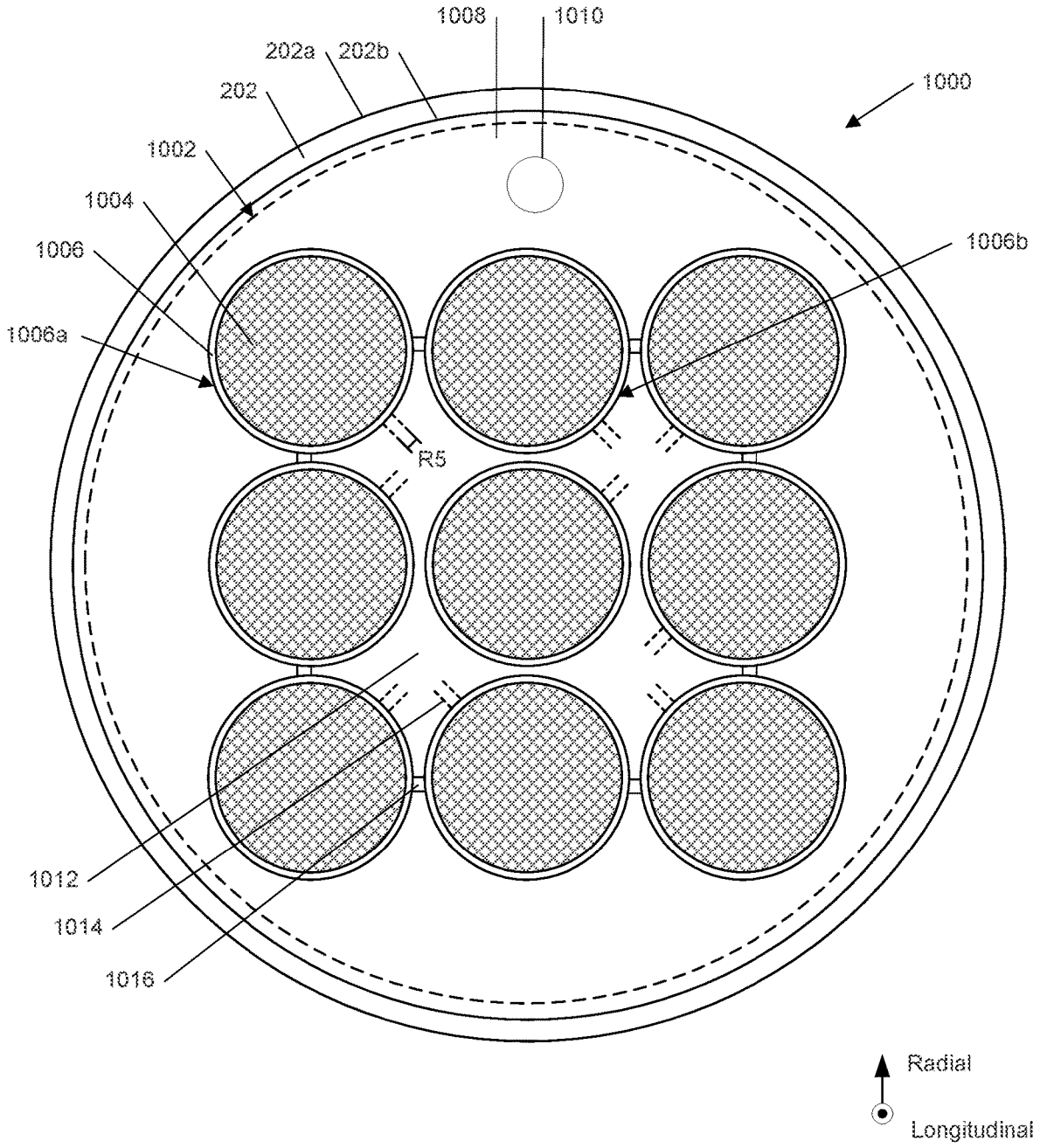
FIG. 10 is a radial cross-sectional illustration of a reduction device that incorporates sound attenuation components in parallel with multiple exhaust channels according to further examples of the present disclosure.

FIG. 10 is a radial cross-sectional illustration of a reduction device that incorporates sound attenuation components in parallel with multiple exhaust channels according to further examples of the present disclosure. In some examples, reduction device 1000 can share some components with the reduction device 200 or include additional components different from the reduction device 200 (not illustrated). In particular, the reduction device 700 includes a housing 202, an external surface 202*a*, and/or an internal surface 202*b*. Additionally, the reduction device 1000 can include an internal volume 1002, a plurality of treatment units 1004, a plurality of exhaust channels 1006, a plurality of substantially fluid tight seals 1006*a* and 1006*b*, a first resonator 1008, a first resonator opening 1010, a second resonator 1012, a second resonator opening (or a plurality of second resonator openings) 1014, and a substantially fluid tight seal 1016. It should be noted that the exhaust channels 1006, the first resonator 1008, the second resonator 1012, and the various substantially fluid tight seals can be configured to substantially prevent throughflow from an upstream volume to a downstream volume and/or substantially prevent the exhaust from bypassing the treatment units 1004.

In some examples, the housing 202 can be radially outward of the other components of the reduction device 1000 and can be configured to provide structural support for the internal components (e.g., the treatment units 1004, the exhaust channels 1006, the first resonator 1008, the second resonator 1012, etc.). While the housing 202 is depicted as being cylindrical, the housing 202 may be any three-dimensional (3D) shape that exhaust from a power system can longitudinally traverse from input to output. Additionally, the housing 202 can comprise an external surface 202*a* that is radially outward of an inner surface 202*b*, wherein the internal components of the reduction device 1000 can be secured by and/or affixed to the inner surface 202*b* of the housing 202. Further, the housing 202 can define the internal volume 1004 for the treatment of power system exhaust and attenuating sounds from the power system.

In some examples, the exhaust channels 1006 extend longitudinally along and/or within at least a portion of the internal volume 1002 of the housing 202. In such examples, the exhaust channels 1006 are, at least in part, in fluid communication with an input of the reduction device 1000 and an output of the reduction device 1000. Additionally, the treatment units 1004 and, optionally, a support lattice associated with the treatment units 1004 can be disposed within the exhaust channels 1006 and supported at least in part by the exhaust channels 1006. Further, the exhaust channels 1006 can be configured such that exhaust entering the reduction device 1000 travels through the exhaust channels 1006 before exiting the reduction device 1000. In at least one example, the exhaust channels 1006 form the substantially fluid tight seal 1006*a* with the first resonator 1008, the substantially fluid tight seal 1006*b* with the second resonator 1012, and/or an additional substantially fluid tight seal with the inner surface 202*b* of the housing 202 (not illustrated) such that the exhaust is prevented from bypassing the exhaust channels 1006. Accordingly, and independent of the specific configuration of the exhaust channels 1006, the input and output of the reduction device 200 are in fluid communication with the exhaust channel 206 and the exhaust channel 206 can be configured to prevent untreated exhaust from traversing the reduction device 200 from the input to the output.

In some additional examples of the exhaust channels 1006, the input and the output of the reduction device 1000 are in fluid communication and enable exhaust to traverse the reduction device 1000. For example, the input and the output of the reduction device 1000 can be disposed on opposite longitudinal ends of the housing 202. Additionally, the input and the output of the reduction device can be disposed on a first longitudinal surface and a second longitudinal surface (e.g., flat surfaces located on either end of the housing 202 that are perpendicular to the central, longitudinal axis of the reduction device 1000 or conical structures located on either end of the housing 202 that have a central longitudinal axis that is parallel to the longitudinal axis of the reduction device 1000) of the housing 202. Alternatively, or in addition, the input and the output of the reduction device 1000 can be disposed on a radial surface (e.g., the exterior surface 202*b* of the reduction device 1000) of the reduction device 1000.

In some further embodiments of the exhaust channels 1006, the exhaust channels 1006 can be configured as a cylindrical wall that encloses the treatment units 1004, a rectangular wall that includes a first wall, a second wall, a third wall, and a fourth wall, similar to the exhaust channel 206, or some other shape that encloses the treatment units 1004.

In some examples, the plurality of treatment units 1004 can be located within the exhaust channels 1006 to treat exhaust traversing the reduction device 1000. In particular, the treatment units 1004 can be disposed within the exhaust channels 1006 such that substantially all exhaust that enters the reduction device 1000 passes through at least one of the treatment units 1004. It should be noted that the exhaust channels 1006 can be configured to include one or more treatment units of the plurality of treatment units 1004 such that the number of treatment units within the exhaust channels 1006 is substantially the same for all of the exhaust channels 1006. Additionally, the treatment units 1004 within the exhaust channels 1006 can be configured in any number of radial layers and longitudinal layers similar to the exhaust channels of reduction devices 200-900. Further, the treatment units 1004 can be supported by a support lattice that secures the treatment units 1004 within the exhaust channel 1006. For example, the support lattice can include bars, plates, and/or other structures that are welded, fastened, and/or otherwise joined to form a matrix in which the treatment units 1004 are disposed. Alternatively, or in addition, the treatment units 1004 can be secured within the support lattice via compressive force (e.g., the support lattice 210 is formed such that pairs of lattice legs are secured to apply compressive force to the treatment units 1004 and prevent dislocation), fasteners, welds, and/or other components. Further, individual lattice legs of the support lattice can form a substantially fluid tight seal between individual treatment units and/or the exhaust channel 1006. Accordingly, the treatment units 1004 can be placed within the exhaust channels 1006 to convert and/or capture pollutant species within the exhaust such that gaseous species exiting the reduction device 1000 can be output to atmosphere and substantially prevent untreated exhaust from bypassing the treatment units 1004.

In some examples, sound attenuation devices and/or components can be installed within the housing 202 and outside of the exhaust channels 1006 such that internal volume 1002 of the reduction device 1000 that would typically remain empty around the exhaust channels 1006 can be utilized to assist with sound attenuation. In particular, the first resonator 1008 and the second resonator 1012 can be selected from various resonators that are configured to attenuate sound generated by a power system associated with the reduction device 1000 (e.g., power system 100). For example, the first resonator 1008 and the second resonator 1012 can be selected from Helmholtz resonators, ¼ wavelength resonators, and/or other resonators that can target a sound frequency or a range of sound frequencies. Additionally, the Helmholtz resonators, the ¼ wavelength resonators, and/or the other resonators can be configured as passive resonators (e.g., resonators that attenuate a set range of frequencies) or semi-active resonators (e.g., resonators that attenuate a range of frequencies that is determined by a modifiable volume within the resonator). In at least one embodiment, the reduction device 1000 can also include an active resonator that generates an opposite phase sound wave that attenuates the soundwaves generated by the power system. For example, where a sound wave traversing the reduction device has a trough (e.g., low pressure zone) the active resonator can generate a pressure peak and where the sound wave has a peak the active resonator can generate a trough such that the overall pressure exiting the reduction device 1000 is at a constant pressure. Accordingly, the first resonator 1008 and the second resonator 1012 can be selected from various resonator types and configurations to attenuate sound from the associated power system.

In some additional examples, the first resonator 1008 can be selected from a Helmholtz resonator, a ¼ wavelength resonator, or another type of resonator to attenuate sounds within the reduction device 1000. In particular, the first resonator 1008 can be configured to occupy a portion of the internal volume 1002 between the housing 202 and the exhaust channels 1006 and/or between individual exhaust channels of the plurality of exhaust channels 1006. Additionally, the first resonator 1008 can be configured to form the substantially fluid tight seal with the housing 202 and the substantially fluid tight seal 1006*a* with the exhaust channels 1006 such that exhaust entering the reduction device 1000 is substantially prevented from bypassing the treatment units 1004 via the first resonator 1008. Further, the first resonator 1008 can be exposed to the input of the reduction device 1000, the output of the reduction device 1000, or to the intra-treatment unit volumes between different radial layers of the treatment units 1004 (not illustrated by FIG. 2). Accordingly, the first resonator 1008 can be configured such that the gas within the first resonator 1008 is substantially similar to the gas within the portion of the reduction device 1000 that the first resonator 1008 is exposed to. More specifically, the first resonator 1008 can encompass a volume of gas that can enter and exit the first resonator 1008 via the first resonator opening 1010 (e.g., an opening for the first resonator corresponding to resonator opening 220 of the additional resonators 218). As discussed by FIG. 4, the first resonator 1008 (and other resonators associated with the reduction device 1000) can be configured to be in fluid communication with a portion of the reduction device 1000 and substantially isolated from other portions of the reduction device 1000 to substantially prevent and/or restrict exhaust from bypassing the treatment units 1004. For example, the first resonator 1008 can be in fluid communication with the input chamber of the reduction device 1000 and fluidly isolated from the output chamber of the reduction device 1000 such that exhaust that enters the first resonator 1008 from the input chamber exits the first resonator back into the input chamber before traversing the treatment units 1004 and the exhaust channels 1006 to the output chamber.

Similarly, the second resonator 1012 can be selected from a Helmholtz resonator, a ¼ wavelength resonator, or another type of resonator to attenuate sounds within the reduction device 1000. In particular, the second resonator 1012 can be configured to occupy a portion of the volume between the exhaust channels 1006. Additionally, the second resonator 1012 can be configured to form the substantially fluid tight seal 1006*b* in combination with the exhaust channels 1006, similar to the first resonator 1008, such that exhaust entering the reduction device 1000 is prevented from bypassing the treatment units 1004 via the resonators. As illustrated by FIG. 10, the second resonator 1012 can be configured such that the second resonator openings 1014 (e.g., openings for a Helmholtz resonator) are exposed to the intra-treatment unit volumes within the exhaust channels 1006. Further, the second resonator 1012 can be exposed to substantially the same intra-treatment unit volume within each of the exhaust channels 1006. For example, the second openings 1014 can be configured to expose the second resonator 1012 to the second intra-treatment unit volume between a second radial layer and a third radial layer of treatment units within each of the exhaust channels 1006 such that exhaust that enters the second resonator 1012 can exit from a first exhaust channel and enter a second exhaust channel and be treated by a number of treatment units that remains substantially constant regardless of whether the exhaust moves between exhaust channels. Alternatively, or in addition, the second resonator openings 1014 may be associated with a single resonator for each of the exhaust channels such that the second resonator 1012 is subdivided into individual resonators that are associated with the individual exhaust channels. Additionally, there may be some embodiments where the second resonator openings 1014 are connected to different intra-treatment unit volumes within the exhaust chambers 1006 and are configured such that the throughflow exhaust that bypasses one or more of the treatment units 1004 is below a bypass threshold. Accordingly, the first resonator 1008, the second resonator 1012, and/or any additional resonators can provide sound attenuation via exposure to various portions of the reduction device 1000. In at least one example, the second resonator openings 1014 can be configured to share a radius R5 that defines the cross-sectional area of the second resonator openings 1014 and partially defines the frequency and/or the range of frequencies attenuated by the second resonator 1012. In at least one additional example, the second resonator openings 1014 can be configured to be associated with various radii that define the cross-sectional areas of individual openings of the second resonator openings 1014 and partially define the frequency and/or the range of frequencies attenuated by the second resonator 1012.

In some examples, the substantially fluid tight seal 1016 can be formed between a wall of the first resonator 1008, the second resonator 1012, and/or one or more of the exhaust channels 1006 to substantially prevent the exhaust from bypassing the treatment units 1004.

Figure 11:
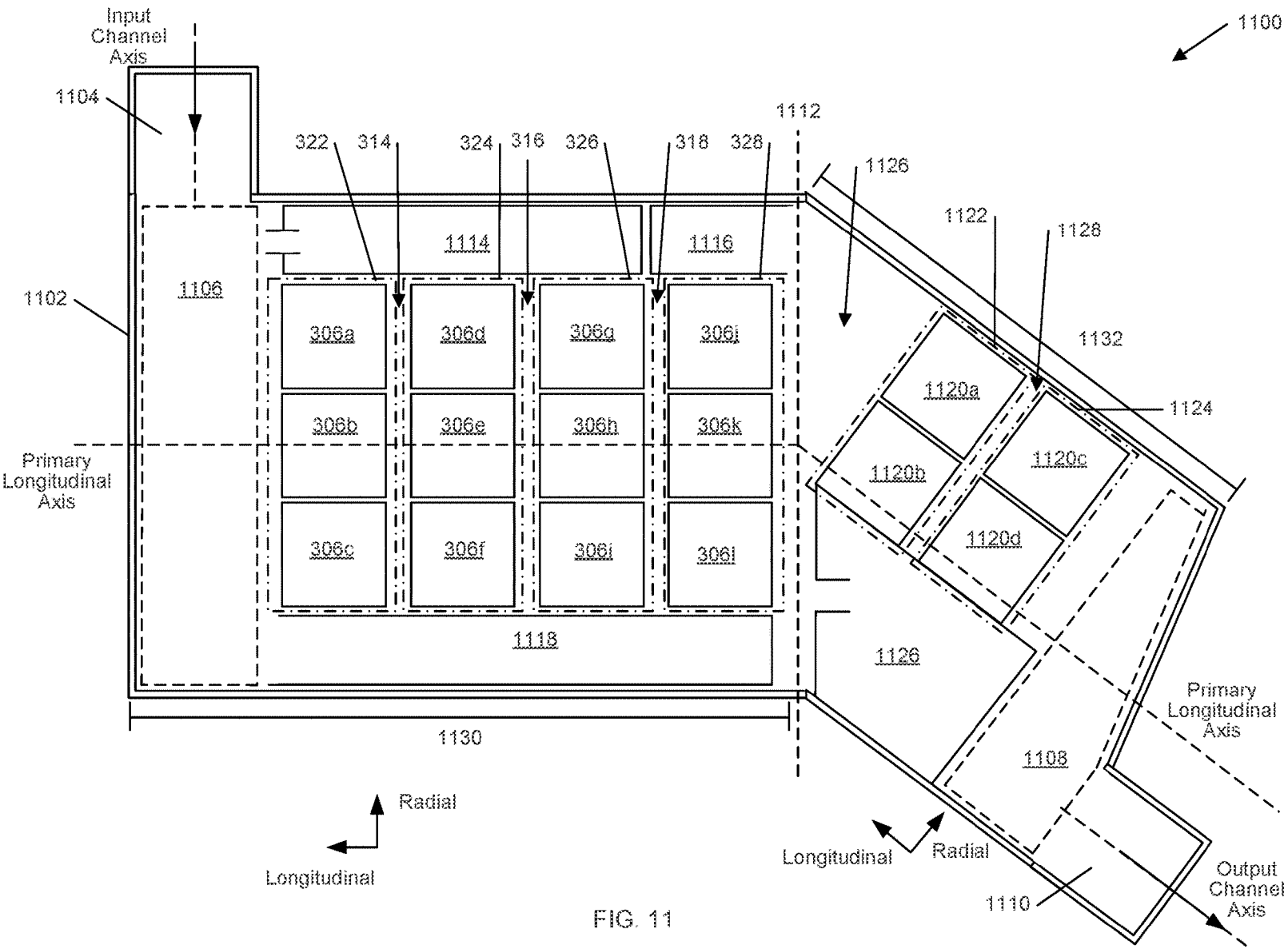
FIG. 11 is a longitudinal cross-sectional illustration of a reduction device that incorporates sound attenuation components in parallel with treatment units and includes an elbow that changes the direction of the longitudinal axis of the reduction device

FIG. 11 is a longitudinal cross-sectional illustration of a reduction device 1100 that incorporates sound attenuation components in parallel with treatment units and includes an elbow that changes the direction of the longitudinal axis of the reduction device. In some examples, the reduction device 1100 can share some components with the reduction device 300 or include additional components different from the reduction device 300 (not illustrated). In particular, the reduction device 1100 can include treatment units 306*a*-306*l*, a first intra-treatment unit volume 314, a second intra-treatment unit volume 316, and a third intra-treatment unit volume 318 (e.g., longitudinally disposed volumes that are between two radial layers of treatment units 306*a*-306*l*), a first radial layer 322, a second radial layer 324, a third radial layer 326, and a fourth radial layer 328. Additionally, the reduction device 1100 can include a housing 1102, an input channel 1104, an input chamber 1106, an output chamber 1108, an output channel 1110, a housing elbow 1112, a Helmholtz resonator 1114, a ¼ wavelength resonator 1116, a ¼ wavelength resonator 1118, one or more additional treatment units 1120*a*-1120*d*, a fifth radial layer 1122, a sixth radial layer 1124, a Helmholtz resonator 1126, and a fourth intra-treatment unit volume 1128. Further, the input chamber 1106 is positioned longitudinally upstream of the treatment units 306*a*-306*l*, one or more intra-treatment unit volumes (e.g., a first intra-treatment unit volume 314 through a third intra-treatment unit volume 318), and the output chamber 1108 that is positioned longitudinally downstream of the one or more additional treatment units 1120*a*-1120*d*.

In some examples, the input channel 1104 can be configured to receive exhaust output by an associated power system (e.g., power system 100) for the reduction device 1100. In particular, the input channel 1104 can be a pipe, a tube, and/or other substantially hollow portion of the housing 1102 that is configured to receive exhaust from an associated power system, direct the exhaust to the input chamber 1106, and has a substantially central input channel axis. It should be noted that the primary longitudinal axis is disposed substantially central to housing 1102 of the reduction device 1100 and the input channel axis is disposed substantially central to the input channel 1104 such that the primary longitudinal axis and the input channel axis can be parallel, perpendicular, and/or otherwise aligned to intersect. Accordingly, the input channel 1104 can be configured to input exhaust from any position on the upstream portion of the reduction device 1100. This can include one or more walls of the housing 1102 that are disposed on the upstream portion of the reduction device 1100 that enclose the input chamber 1106.

Additionally, the input channel 1104 can be fluidly connected to an input chamber 1106 that precedes the treatment units 306*a*-306*l*, the Helmholtz resonator 1114, the ¼ wavelength resonator 1116, the ¼ wavelength resonator 1118, the additional treatment units 1120*a*-1120*d*, the Helmholtz resonator 1126, and/or any additional attenuation components within the housing 1102. In particular, the input chamber 1106 may be in fluid communication with the Helmholtz resonator 1114, the ¼ wavelength resonator 1118, any additional attenuation components, and/or the treatment units 306*a*-306*l*. Additionally, the Helmholtz resonator 1114, the ¼ wavelength resonator 1118, and/or any additional attenuation components in fluid communication with the input chamber 1106 can be substantially sealed such that exhaust entering the Helmholtz resonator 1114, the ¼ wavelength resonator 1118, and/or the additional attenuation components is substantially prevented from bypassing the treatment units 306*a*-306*l*. In at least one example, the Helmholtz resonator 1114, the ¼ wavelength resonator 1118, and/or any additional attenuation components can be configured to extend from the first portion 1130 of the housing 1102 through the housing elbow 1112 and into the second portion 1132 of the housing 1102. Accordingly, the Helmholtz resonator 1114, the ¼ wavelength resonator 1118, and/or any additional attenuation components can be configured to prevent the exhaust from bypassing the additional treatment units 1120*a*-1120*d* and/or the treatment units 306*a*-306*l*. It should be noted that the input chamber 1106 is defined by the housing 1102, the input channel 1104, the treatment units 306*a*-306*l*, the Helmholtz resonator 1114, the ¼ wavelength resonator 1118, and/or any additional resonators such that the exhaust is permitted to enter the input chamber 1106 via the input channel 1104 and exit the input chamber 1106 via the first radial layer 322 of the treatment units 306.

In some examples, after passing through the treatment units 306*a*-306*l* and the additional treatment units 1120*a*-1120*d*, the exhaust enters the output chamber 1108. Similar to the input chamber 1106, the output chamber 1108 can be downstream of the treatment units 306*a*-306*l*, downstream of the additional treatment units 1120*a*-1120*d*, and in fluid communication with the output channel 1110, the treatment units 306*a*-306*l*, the additional treatment units 1120*a*-1120*d*, the Helmholtz resonator 1126, and/or any additional attenuation components within the housing 1102. Additionally, the Helmholtz resonator 1126 and/or any additional attenuation components in fluid communication with the output chamber 1108 can be substantially sealed such that exhaust entering the Helmholtz resonators 1126 and/or the additional attenuation components is substantially prevented from bypassing the additional treatment units 1120*a*-1120*d*. It should be noted that the output chamber 1108 is defined by the housing 1102, the output channel 1110, the treatment units 306*a*-306*l*, the Helmholtz resonator 1126, and/or any additional resonators such that the exhaust is permitted to enter the output chamber 1108 via the sixth radial layer 1124 of the treatment units and exit the output chamber 1108 via the output channel 1110.

In some examples, the output channel 1110 can be configured to output exhaust received from and treated by the treatment units 306*a*-306*l* and the additional treatment units 1120*a*-1120*d*. In particular, the output channel 1110 can be fluidly connected to the additional treatment units 1120*a*-1120*d* via the output chamber 1108 such that treated exhaust from the power system is directed from the output chamber 1108, through the output channel 1110, and output to an external environment such as the atmosphere. Similar to the input channel 1104, the output channel 1110 can be a pipe, a tube, and/or other substantially hollow portion of the housing 1102 that is configured to receive the treated exhaust from the additional treatment units 1120*a*-1120*d* via the output chamber 1108 and has a substantially central output channel axis. Further, the output channel 1110 can be positioned such that the output channel axis is offset from the primary longitudinal axis of the reduction device 1100. It should be noted that the primary longitudinal axis is disposed substantially central to the second portion 1132 of the housing 1102. Accordingly, the output channel 1110 can be configured to output exhaust from any position on the downstream portion of the reduction device 1100. This can include one or more walls of the housing 1102 that are disposed on the downstream portion of the reduction device 1100 that enclose the output chamber 1108.

In some examples, the housing 1102 can include the housing elbow 1112 such that the first portion 1130 of the housing 1102 and the second portion 1132 of the housing 1102 are associated with non-parallel central axis. It should be noted that the central longitudinal axis is defined by the central axis of the first portion 1130 and the central axis of the second portion 1132 within the respective portion of the housing 1102. Additionally, while the housing 1102 is shown to include the single housing elbow 1112 of approximately 45 degrees, the housing 1102 can include any number of elbows having a variety of degrees (e.g., a 90 degree elbow, a 180 degree elbow, a 120 degree elbow, etc.) Accordingly, the housing may include the housing elbow 1112 such that individual treatment units and resonators are located relative to one another in parallel or in series based on the central longitudinal axis for the first portion 1130 and the second portion 1132 of the housing 1102. Additionally, it should be noted that longitudinal progression from upstream components (e.g., treatment units 306*a*-306*l*, resonators 1114, 1116, and 118, etc.) to downstream components (e.g., additional treatment units 1120*a*-1120*d*, Helmholtz resonator 1126, etc.) is continued through the housing elbow 1112.

In some examples, and independent of position within the first portion 1130 or the second portion 1132 of the housing 1102, the Helmholtz resonator 1114, the ¼ wavelength resonator 116, the ¼ wavelength resonator 118, and/or the Helmholtz resonator 1126 can be configured in a manner similar to that discussed by FIGS. 1-10. Similarly, the addition treatment units 1120*a*-1120*d*, the fifth radial layer 1122, the sixth radial layer 1124, and the fifth intra-treatment volume 1128 can be configured similar to the first intra-treatment unit volume 314, the second intra-treatment unit volume 316, the third intra-treatment unit volume 318, first radial layer 322, the second radial layer 324, the third radial layer 326, and the fourth radial layer 328. It should be noted that while the fourth intra-treatment unit volume 1126 may be configured similar to the other intra-treatment unit volumes, the fourth intra-treatment unit volume 1126 can be configured to include additional volume, treatment units, and/or resonators that occupy the excess volume caused by the housing elbow 1112. More specifically, as there is a variable longitudinal length at the boundary between the first portion 1130 and the second portion 1132 of the housing 1102, the fourth intra-treatment unit volume 1126 may be configured to incorporate additional components that are shaped to fit within the transition between the first portion 1130 and the second portion 1132.

INDUSTRIAL APPLICABILITY

The present disclosure describes systems and methods for sound attenuation. The example systems and methods described herein can be used with reduction systems for internal combustion-type motors, and the disclosed systems are configured to target specific frequencies of noise content. An exhaust treatment component is comprised of an exterior housing that defines an input channel that receives exhaust from an associated power source, an output channel downstream of the input channel, an internal volume, and a longitudinal axis that extends through the internal volume. The internal volume includes an exhaust channel that contains one or more treatment units for capturing pollutants and/or converting pollutant species to emission species (e.g. pollutant species are to be reduced by the treatment units by conversion into the emission species that can be vented to atmosphere) and directs exhaust from the input channel to the output channel. The treatment units are disposed within the exhaust channel along the longitudinal axis, optionally in radial layers containing multiple treatment units. Additionally, the internal volume includes attenuation components that are disposed radially outward of the treatment units and are fluidly connected to the exhaust channel to attenuate a range of frequencies. The attenuation components can form substantially fluid tight seals that, while providing attenuation, the attenuation components prevent exhaust from bypassing the treatment units within the exhaust channel. Similarly, the exhaust channel prohibits exhaust entering the input channel from exiting the housing without passing through the treatment units. Accordingly, excess volume within the housing of the reduction system can be occupied by attenuation components that are disposed in the same radial planes as the treatment units. Placement of the attenuation components within the excess volume enables attenuation to be provided without the expense of an additional devices specialized for attenuating the sound waves produced by an operating gen-set.

According to embodiments of the present disclosure, the devices described herein reduce the amplitude of sound waves by a determined number of decibels such that a target noise threshold is satisfied by the sound output by a gen-set across a wide spectrum of frequencies. Additionally, the incorporation of attenuating apparatuses into the available volume between the external housing and reduction catalysts takes advantage of unused volume and reduces or eliminates the need for additional attenuation apparatuses that are independent of the reduction device. Moreover, embodiments described herein can minimize cost associated with manufacturing the apparatuses by combining sound attenuation components with the reduction device to simplify the overall system, reduce the footprint of the system within facilities, and potentially eliminate the need for an additional system that reduces overall system complexity.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A reduction device, comprising:

a housing defining:

an input chamber configured to receive exhaust from a power source, an output chamber downstream of the input chamber, an exhaust channel disposed between the input chamber and the output chamber, the exhaust channel configured to direct the exhaust from the input chamber to the output chamber, and a longitudinal axis extending substantially centrally through the housing;

a treatment unit disposed in the exhaust channel and along the longitudinal axis, the treatment unit including a first surface facing the input chamber, the first surface being configured to receive the exhaust from the input chamber, the treatment unit being configured to at least partly remove pollutant species from the exhaust as the exhaust passes through the exhaust channel; and an attenuation component disposed in the housing and radially outward of the treatment unit, wherein:

an inlet of the attenuation component is formed by a second surface of the attenuation component downstream of the input chamber and substantially coplanar with the first surface, the input chamber directs the exhaust received from the power source unimpeded to the inlet, the attenuation component is fluidly connected to the exhaust channel, and is configured to attenuate a range of frequencies corresponding to operation of the power source at a rated load, and the exhaust channel prohibits exhaust entering the input chamber from exiting the housing without passing through the treatment unit.

2. The reduction device of claim 1, wherein:

the input chamber comprises an open internal volume of the housing formed by a radially outermost wall of the housing, the open internal volume extending from a first internal surface of the radially outermost wall to a second internal surface of the radially outermost wall facing the first internal surface.

3. The reduction device of claim 1, wherein the treatment unit further comprises:

a treatment unit housing including:

a first wall, a second wall substantially parallel to the first wall, a third wall, and a fourth wall substantially parallel to the third wall, the first wall and the second wall being connected to the third wall and the fourth wall at substantially right angles; and a substrate disposed within the treatment unit housing, the substrate formed from one of a metallic material and a ceramic material, and being configured to remove particulates from the exhaust as the exhaust passes through the treatment unit.

4. The reduction device of claim 3, wherein:

the treatment unit housing is connected to and disposed within the exhaust channel; and the exhaust channel is configured to direct the exhaust from the input chamber to the output chamber via the treatment unit housing.

5. The reduction device of claim 1, wherein:

the attenuation component comprises a first attenuation component fluidly connected to a first portion of the exhaust channel upstream of the treatment unit; and the reduction device further includes a second attenuation component separate from the first attenuation component, the second attenuation component being fluidly connected to a second portion of the exhaust channel downstream of the treatment unit.

6. The reduction device of claim 5, further comprising a sealing plate connected to the exhaust channel and to an inner surface of the housing, the sealing plate prohibiting the exhaust entering the input chamber from exiting the housing without passing through the treatment unit.

7. The reduction device of claim 1, wherein the rated load is associated with a steady state operation of the power source, and wherein the steady state operation of the power source is defined by: a substantially constant rotations per minute (RPM) of the power source, a substantially constant power output of the power source, and a substantially constant temperature of the flow of exhaust.

8. A method, comprising:

receiving exhaust at an input chamber of a housing, the input chamber being in fluid communication with an output chamber of the housing via an exhaust channel of the housing;

attenuating, with an attenuation component disposed within the housing and fluidly connected to the exhaust channel, a range of frequencies associated with the exhaust as the exhaust passes through the exhaust channel;

removing, with at least one of a first treatment unit and a second treatment unit, a pollutant species from the exhaust as the exhaust passes through the exhaust channel, the first treatment unit being disposed within the exhaust channel and including a first surface facing the input chamber, the first surface receiving the exhaust from the input chamber, the second treatment unit being disposed within the exhaust channel downstream of, and spaced from, the first treatment unit, and the attenuation component being disposed radially outward of the first treatment unit and the second treatment unit, wherein an inlet of the attenuation component is formed by a second surface of the attenuation component downstream of the input chamber and substantially coplanar with the first surface;

directing, by the input chamber, the received exhaust unimpeded to the inlet; and directing the exhaust to exit the housing via the output chamber, the exhaust channel prohibiting the exhaust from exiting the housing via the output chamber without passing through the at least one of the first treatment unit and the second treatment unit.

9. The method of claim 8, wherein:

the second treatment unit includes a third surface facing the first treatment unit and configured to receive exhaust from the first treatment unit; and the input chamber comprises an open internal volume of the housing substantially surrounding the inlet of the attenuation component.

10. The method of claim 8, wherein the attenuation component comprises a first attenuation component, the method further comprising attenuating, with a second attenuation component disposed within the housing and fluidly connected to the exhaust channel, a subset of the range of frequencies, the second attenuation component being disposed radially outward of the second treatment unit.

11. The method of claim 10, wherein:

the second treatment unit includes a third surface facing the first treatment unit and configured to receive exhaust from the first treatment unit; and the second attenuation component includes a fourth surface facing the first attenuation component, the fourth surface being disposed substantially coplanar with the third surface.

12. The method of claim 8, wherein a first substantially fluid tight seal is formed between an inner surface of the housing and the attenuation component, and a second substantially fluid tight seal is formed between the exhaust channel and the attenuation component, the first and second substantially fluid tight seals prohibiting the exhaust from exiting the housing via the output chamber without passing through the at least one of the first treatment unit and the second treatment unit.

13. The method of claim 8, wherein the attenuation component comprises one of a Helmholtz resonator and ¼ wavelength resonator, and the first treatment unit comprises a substrate formed from one of a metallic material and a ceramic material, the substrate being coated with a reduction catalyst.

14. The method of claim 8, wherein the housing comprises a substantially cylindrical housing, and the exhaust channel comprises a first wall connected to and extending substantially perpendicular to a second wall, a third wall connected to and extending substantially perpendicular to the second wall, and a fourth wall connected to and extending substantially perpendicular to the third wall and the first wall, the exhaust channel being supported, at least in part, by an inner surface of the housing, and the first and second treatment units being supported by a support lattice connected to at least one of the first wall, the second wall, the third wall, and the fourth wall.

15. A system, comprising:

a power source configured to emit exhaust; and a reduction device fluidly connected to the power source and configured to receive the exhaust, the reduction device comprising:

a housing defining an input chamber, an output chamber downstream of the input chamber, and a longitudinal axis, an exhaust channel fluidly connecting the input chamber with the output chamber, the longitudinal axis of the housing extending substantially centrally through the exhaust channel, a plurality of treatment units disposed within the exhaust channel, the plurality of treatment units being configured to remove pollutant species from the exhaust as the exhaust passes through the exhaust channel;

a plurality of attenuation components disposed within the housing and fluidly connected to the exhaust channel, the plurality of attenuation components being:

configured to attenuate a range of frequencies associated with the exhaust passing through the exhaust channel, and corresponding to operation of the power source at a rated power load, and disposed radially outward of the plurality of treatment units; and a support lattice connected to at least one wall of the exhaust channel and supporting the plurality of treatment units within the exhaust channel, wherein:

the reduction device is configured such that the exhaust received from the power source is prohibited from exiting the housing without passing through at least one treatment unit of the plurality of treatment units, a first treatment unit of the plurality of treatment units includes a first surface facing the input chamber, the first surface being configured to receive the exhaust from the input chamber, a first attenuation component of the plurality of attenuation components includes an inlet formed by a second surface of the first attenuation component, the second surface being downstream of the input chamber and substantially coplanar with the first surface, and the input chamber directs the exhaust received from the power source unimpeded to the inlet.

16. The system of claim 15, wherein the reduction device further includes attenuating material disposed within the housing and radially outward of the exhaust channel.

17. The system of claim 15, wherein:

the input chamber comprises an open internal volume of the housing formed by a radially outermost wall of the housing, the open internal volume extends from a first internal surface of the radially outermost wall to a second internal surface of the radially outermost wall facing the first internal surface, and the open internal volume substantially surrounds the inlet of the first attenuation component.

18. The system of claim 15, wherein the first treatment unit is disposed along the longitudinal axis, the plurality of treatment units further comprising a second treatment unit disposed along the longitudinal axis and spaced from the first treatment unit.

19. The system of claim 18, wherein:

the first surface defines a first plane extending substantially perpendicular to the longitudinal axis;

the second treatment unit includes a third surface facing the output chamber, the third surface defining a second plane extending substantially perpendicular to the longitudinal axis; and at least one attenuation component of the plurality of attenuation components is disposed, at least in part, at a location, within the housing and external to the exhaust channel, between the first plane and the second plane.

20. The system of claim 18, wherein at least one attenuation component of the plurality of attenuation components is fluidly isolated from a portion of the exhaust channel extending from the first treatment unit to the second treatment unit.

* * * * *